US009689105B2

(12) United States Patent
Martinez Villarreal

(10) Patent No.: US 9,689,105 B2
(45) Date of Patent: Jun. 27, 2017

(54) AUTOMATIC DISPENSER FOR DETERGENT AND CHLORINE ADDITIVES

(71) Applicant: MABE, S.A. DE C.V., Santiago de Queretaro, Queretaro (MX)

(72) Inventor: Luis Alberto Martinez Villarreal, Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 482 days.

(21) Appl. No.: 14/287,112

(22) Filed: May 26, 2014

(65) Prior Publication Data

US 2014/0352364 A1 Dec. 4, 2014

(30) Foreign Application Priority Data

May 31, 2013 (MX) ..... MX/a/2013/006149

(51) Int. Cl.
*D06F 39/02* (2006.01)
*D06F 23/04* (2006.01)

(52) U.S. Cl.
CPC ..... *D06F 39/022* (2013.01); *D06F 39/028* (2013.01); *D06F 23/04* (2013.01)

(58) Field of Classification Search
CPC ..... D06F 39/022
See application file for complete search history.

(56) References Cited

U.S. PATENT DOCUMENTS

| | | | |
|---|---|---|---|
| 4,700,554 | A | 10/1987 | Eichman et al. |
| 7,900,486 | B2 | 3/2011 | Richman et al. |
| 2005/0144737 | A1 | 7/2005 | Roepke et al. |
| 2005/0188730 | A1 | 9/2005 | Zsambeki |
| 2005/0229645 | A1 | 10/2005 | Kim et al. |

*Primary Examiner* — Jason Ko
(74) *Attorney, Agent, or Firm* — Terry M. Sanks, Esq.; Beusse Wolter Sanks & Maire, PLLC

(57) ABSTRACT

An additive dispenser for an automatic washing machine includes a container with a compartment for a wash additive. The compartment has a siphon system and a water fall on a wall of the compartment. A flow homogenizing system at the entrance of the dispenser includes: (a) a connection nozzle with an inner part, where the connection nozzle allows communication with a source of wash water, and the inner part of the connection nozzle has two areas with a different size to produce a Venturi effect; and (b) a damping tank with a container and a cover. The homogenizing system homogenize the wash water flow which enters. A perimeter pathway for the transfer of the wash water is formed by the container and the cover; and a deflector to direct the wash water flow which travels through the perimeter pathway.

15 Claims, 25 Drawing Sheets

AUTOMATIC DISPENSER FOR DETERGENT AND CHLORINE ADDITIVES

RELATED APPLICATIONS

This application claims priority from Mexican Application Serial No. MX/a/2013/006149 filed May 31, 2013, which is incorporated herein by reference in its entirety.

FIELD OF THE INVENTION

Present invention describes a dispenser for additives such as detergent and chlorine whose structure allows for completely dispensing the washing additives without leaving residues, particularly for an automatic washing machine preferably for top loading washers, without excluding front loading washers.

BACKGROUND

It is common nowadays to see that automatic washers have at least one dispenser for additives, such as detergent, bleach, softener, among others.

When the dispensing of additives is automatic, the user may place the additives into their own compartments, and by means of the dispenser controller they are activated at a determined time, during the washing cycle, to dispense the additive within the container for the treatment of the garments.

It is well known to dilute the additives to be dispensed with water to achieve uniform distribution of the additives within the tub or basket, whichever the case may be, instead of becoming concentrated in a single area of the container.

Additionally, depending on the geometry of the deposit of the dispenser, and of the water supply device, problems can arise, such as: agglomerations of the powdered additives due to the formation of large lumps of additive in such a way that they are too large to accomplish passing through the dispenser which generally has a groove like shape or they are too wide; another of the problems is when low dilution between the water mixture and the additive exists causing part of the additive to remain floating on the upper part of the supplied water flow, thus impeding it from exiting the dispenser; it has also been found that a significant amount of the additive is sometimes pushed to the ends or another deposit area of the dispenser where it remains as a residue, while the flow of diluted water with the remaining additive exits the dispenser; or simply overflow of the additive occurs given the excess of supply of the same by the user given that the dispenser does not have a maximum amount indicator of the amount to be placed, or overflow due to poor control of the supplied water pressure.

With the passage of time and use of the washing machine, any of the problems such as agglomeration, lack of dilution, residues or overflow can get to the point of reducing functionality of the dispenser, in addition to being aesthetically displeasing to the user.

The different documents which can be found in current literature related to additive dispensers, if they do address the above related questions, have not been able to successfully tackle them, as does present invention.

Among the various efforts which have been undertaken in the field of detergent dispensers, we highlight patent document U.S. Pat. No. 4,700,554 from 1986, where Carl E. Eichman et al makes reference to a granular additive dispenser which includes a separate recipient which can be inserted in order to dispense liquid detergent which makes it different than the additive dispenser of the present invention, which can function both for liquid as well as granulated detergent without using extra additions; in said patent U.S. Pat. No. 4,700,554, the water is supplied to the deposit in conventional manner where through a horizontal channel implemented solely as a means for the exit of the additive, discharges it directly into the tub, which can cause damage to the garments to be treated through direct chemical attack on the textile surface in such a manner, that given this, the additive dispenser of the present invention carries out the additive discharge between the tub and the basket thus avoiding direct contact with the garments to be washed; additionally, Carl E. Eichman in the same patent document U.S. Pat. No. 4,700,554 discloses in his dispenser downwardly inclined walls from the water supply entrance to the additive exit towards the tub, which for the purpose of efficiency in the sweeping and dispensing of the residues, said walls could be insufficient.

Another relevant document to be analyzed is document 20050144737 A1 US from 2005, where Jon Arthur Roepke et al references a system for dispensing additives to a washing machine which includes a removable deposit coupled to the main lid of the washing machine, where by means of a water valve connected to the deposit and a controller, water is introduced into the deposit to dilute the additive and dispense the diluted additive between the tub and the basket at a predetermined time; the advantage of counting with a removable dispenser for purposes of efficiency of dispensation results null, given that the residue problems arise during the washing cycle, not prior to or post the washing cycle, in addition to running the risk of misplacement, given the above, the additive dispenser of present invention is found fixed unto the front part, mechanically connected on the inner part to the main lid of the washing machine.

Another interesting document is US 20050229645 A1 by Jon Min Kim et al. This references an additive dispenser which is characterized by counting with a deposit, an upper cover lid and a lower cover lid, where the lower cover lid has a first water supply channel; afterwards a second channel is located which diverts the water from the first channel and supplies water to the additive deposit, both channels are connected by means of an auxiliary channel; afterwards the water is discharged to the deposit through a plurality of holes found along the length of the channels, where the next step is the diluted additive being released into the tub by means of a bellow; among the disadvantages which can be listed for document US 20050229645 A1, which even the author himself mentions, are the reduction of water flow pressure at the end of the channel opposite to the water entrance, which in present invention is solved thanks to the pressure regulator which has been included at the entrance of the additive dispenser; another disadvantage of Jong Min Kim's et al document is dispensation in such a direct manner into the tub as opposed to present invention, whose releasing of additives occurs between the tub and the basket.

It should also be mentioned that in 2005, Marcus Zsambeki in patent document number US 20050188730 A1 references an additive dispenser for a washing machine which comprises a box in the shape of an indentation and a sliding drawer set with a plurality of separated compartments for containing additives for washing or rinsing which have some entrances in the back part and through which water is supplied towards the compartment through one of the ends of the dispenser where additionally the dispenser has a channel to direct the entering water flow towards the lower part and towards the outside of the sliding drawer with the aspect of sweeping along with the residues; as opposed to the present invention, patent document number US 20050188730 A1 is only concerned with sweeping the residues which remain under and outside the deposit and ignore the residues which remain within the deposit itself; in addition to undertaking the releasing of detergent within the tub which can cause damages to the garments to be washed as was previously mentioned.

Now then, in 2007 Lonnie Joe Richman et al in patent document U.S. Pat. No. 7,900,486 references an additive dispenser which includes a housing made up of a collector which the water supply reaches, and a compartment where the additive is deposited. The water supplied into the collector is transported to the additive compartment through a set of holes found along the length of the wall which divides the collector from the compartment, where the mixing of the water and the additive is ejected by means of a siphon system and discharged between the tub and the basket; said holes rather than being useful for the releasing of the additive, can get to be a problem given that, as was previously mentioned, the exits or openings in the shape of grooves which are too narrow, can become obstructed given the additive agglomerations, which renders the dispenser inefficient; given the latter, present invention has avoided reduced spaces which run the risk of agglomerations or obstructions.

Now then, present invention proposes a configuration for an additive dispenser which has resulted in being highly effective for preventing or resolving the difficulties present in the dispensation as was detailed in the above mentioned documents, as well as other which commonly arise in dispensers.

BRIEF DESCRIPTION OF THE INVENTION

Present invention relates to an additive dispenser for wash, particularly, for use in automatic top loading washing machines for the treatment of laundry. However, the additive dispenser may be used in other household appliances, such as front loading washers for laundry or in dishwashers.

The additive dispenser of the present invention in its preferred embodiment is made up of two pieces, a cover lid and a container which allows for the decreasing of costs given that the configuration in said additive dispenser allows supplying water for wash, understood as wash water, whether it is fresh water arriving directly from external water supply or simply recycled water, in such a way that said wash water supplies each of the additive deposits, comprising one water entrance for all the deposits, in addition to decreasing manufacturing and assembly complexity.

The cover and the container are found joined preferably by a plastic joining method such as adhesive, hot plate, ultrasound, snaps, welding, pressure closure or a combination of the above, in order to avoid leaks due to high work pressures to which it could potentially be subjected to.

The additive dispenser of the present invention is found set on the front part, mechanically connected on the inner part of the main cover lid of the washing machine preferably by means of screws; its position on the front part of the washing machine is for the ease of the user when supplying detergent or any other additive to the deposit. Additionally, an indicator for the maximum level has been included, which forms part of the main cover lid, in light of studies showing that upon lacking this type of indicator may cause some users to add a larger amount than the amount recommended by the manufacturer, which leads to or entails improper functioning of the dispenser, particularly in cases in which the dispensation is by means of a siphon system, given that the wash liquor excess formed by detergents or other additives mixed in the wash water cause the siphon system be activated prior to its time, which causes overfoaming or residue problems in the garments to be laundered.

The configuration of the additive dispenser in its preferred embodiment comprises two compartments, one for dispensing detergent and the other for dispensing bleach.

The detergent, whether it is in powder or in liquid form, falls directly into the reservoir tub cover of the sub-washer passing through a grill which allows the wash liquor to reach between the tub and the basket, where for practical purposes the sub-washer is defined as the complete washing machine except for the cabinet thereof; at the exit of the deposit at least one safety grill is found in order to avoid the passage of different objects other than detergent and cause the drainage pump or other devices in the washing machine to become damaged.

On the other hand, the second deposit of the additive dispenser of the present invention, in its preferred embodiment, is destined for dispensing bleach, which as opposed to the detergent compartment is contained in such a way that the wash liquor is extracted by means of a siphon system, in addition to also being dispensed between the tub and the basket through the tub cover reservoir of the sub-washer.

The additive dispenser of the present invention may also have a homogenizing flow system located at the entrance of the additive dispenser and which may have a set of parts in the additive dispenser which grant it efficiency in the correct distribution of wash water which enters from the supply hose for efficient sweeping of residues, given that for a range of entrance wash water pressure of 20.68 kPa (3 psi)-82.74 kPa (12 psi) the flow pressure of the wash water within the additive dispenser is uniform, this thanks to the flow homogenizer system found in the present invention, which additionally aids in avoiding water overflowing outside of the additive dispenser, given the high pressures. Said flow homogenizing system is made up by a connection nozzle with the wash water supply hose; the end of the connection nozzle which is connected to the hose has a larger diameter than the exit end towards the additive dispenser, forming a truncated cone where immediately afterwards a segment is found which is neck shaped with equal depth to the diameter of the end of the lesser diameter of the truncated cone where an increase in velocity is produced in the flow of wash water which enters and passes through a neck which directs the water flow towards a damping tank which is nothing more than a closed space formed by the container and the cover of the additive dispenser by means of a coupling groove and a coupling joint. Said damping tanker receives the wash water after this crosses the inner part of the connection nozzle, where its function is that of homogenizing the entrance flow of the wash water dissipating kinetic energy which said flow acquires upon increasing its velocity, with the purpose that the additive dispenser works in the same manner both for low pressures (from 20.68 kPa (3 psi)) as well as for high pressures (up to 82.74 kPa (12 psi)).

Afterwards, the perimeter pathway is located which is found in fluid communication with the damping tank which is formed by the container and the cover through which the wash water flow travels with a constant pressure thanks to the flow homogenizing system. Now then, the first section of the additive dispenser of the present invention is found in fluid communication with the damping tank and passes through the bleach deposit, where thanks to a coupling joint which binds perfectly with a coupling groove of the cover, it avoids that the majority of the wash water which enters, remains in the bleach deposit, and in this way can travel to the detergent deposit where the problem of residue dispensation is more relevant. Between the cover and the container a plurality of deflectors are formed whose end purpose is: controlling high pressures, directing wash water within the deposits and avoid overspills. The first releasing of wash water from the perimeter pathway towards the detergent deposit is by means of a linear deflector located between the first section of the additive dispenser of the present invention and the second section of the additive dispenser of the present invention, which channels a part of the wash water which travels through the perimeter pathway towards the detergent deposit and at the same time a smaller quantity of the bleaching deposit by means of a dividing wall which counts with an inclination to allow the passage of wash water and in this manner activate the siphon system, which is formed by a cylindrical body surrounded by the set of reinforcement ribs on the base and a depression which surrounds it in the lower part and which forms part of the container of the additive dispenser, in conjunction with the cover lid which is mushroom shaped, of the siphon system, which may also have reinforcement ribs on the cover lid and which forms part of the cover of said additive dispenser. The remainder of the entering wash water continues travelling through the perimeter pathway where the flow passing area of said perimeter pathway is decreased given a segment of the protrusion of the linear deflector located on the second section of the additive dispenser of the present invention causing an increase in the wash water velocity, thus ensuring that despite the amount of wash water decreasing given the releasing at the first deflection, the wash water continue running in a uniform fashion in the remaining sections of the perimeter pathway.

Afterwards, between the second section of the additives dispenser and the third section of the additives dispenser of the present invention, a curved deflector is found which forms part already of the detergent deposit and which given the velocity increase of the wash water flow upon passing through the reduced passage area, the wash water is recirculated and released through said curved deflector with an effect similar to the water evacuation in a toilet, where said turbulence allows sweeping in an effective manner along with the detergent residues, jointly with a bay found at the bottom of the detergent deposit which aids in the correct dispensing of residues.

Between the third section of the additives dispenser of and the fourth section of the additives dispenser of the present invention, a bi-directional dispenser is found which divides the remaining wash water, which remains flowing through the perimeter pathway to the detergent deposit and to the bleach deposit, thus ensuring complete dispensing of additives. In the fourth section of the additives dispenser of the present invention a waterfall is found which comprises a recess and is found in fluid communication with said perimeter pathway ensuring, through surface tension, at least a wash water trickle to said siphon system to maintain it active and in order to release the wash water in its entirety.

BRIEF DESCRIPTION OF THE FIGURES

The particular features and advantages of present invention, as well as other aspects of the invention, shall become apparent from the following specification, taken in context with the accompanying figures, which are.

DETAILED DESCRIPTION OF THE INVENTION

Theoretical Approach

Present invention is focused on washing machines, particularly on dispensers for additives for automatic top loading washing machines. However, the additive dispenser may be used in other household appliances, such as front loading washers for laundry or in dishwashers.

One of the many benefits which the automation of household appliances has brought into the home is that of minimizing the complexity of common cleaning tasks, making life simpler and lessening complexities for persons, providing benefits of convenience and speed when performing these daily activities.

A striking example is the technological breakthrough in washing machines, automating them to such an extent that the user only has to deposit the garments and merely remove them afterwards and they are ready to use; one of the features of the clothing washing machines which has achieved becoming fully automated, is the use of additive dispensers wherein the additive is dispensed at a particular time during the wash cycle.

The present invention describes the improvement to additive dispensers for top loading washing machines, wherein an additive dispenser with multiple deposits for additives comprises a single water entrance sufficient for sweeping with each one of the deposits in an efficient and clean manner, is proposed; said wash water distribution to all and each one of the additive dispensers is undertaken thanks to a perimeter pathway which passes through all the deposits releasing wash water in a strategic way by means of a plurality of deflectors.

Preferred Embodiment of the Invention

Figure 1:
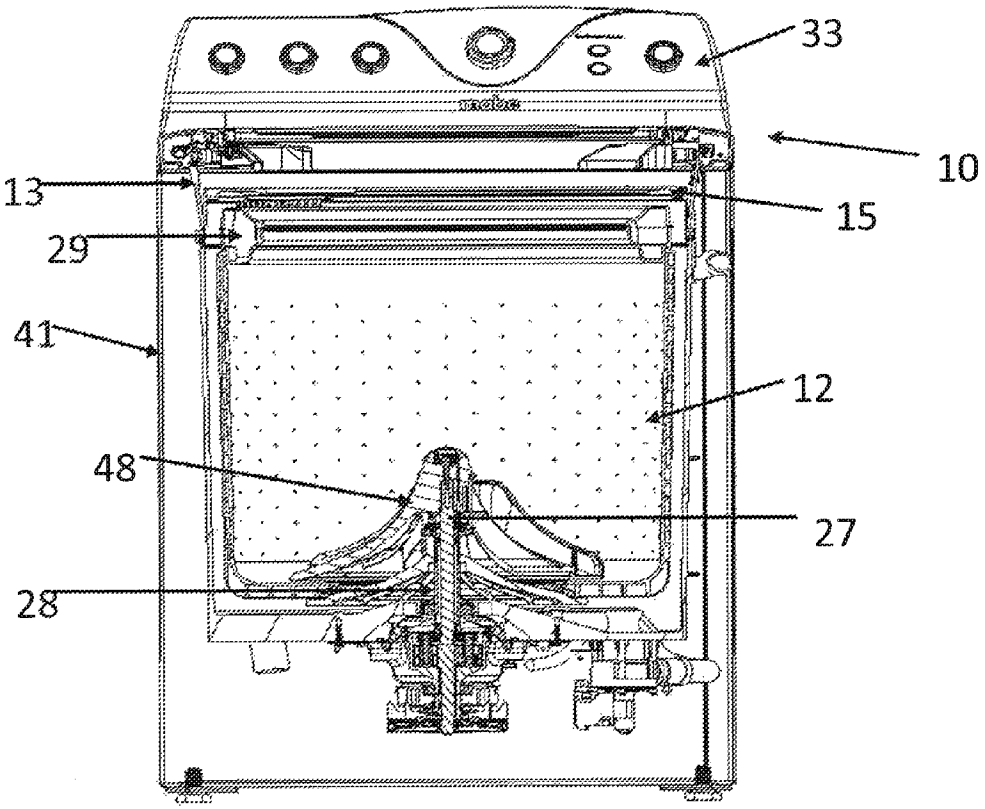
FIG. 1 is a front view of a cross cut of an automatic top loading washing machine for clothes.
Figure 2:
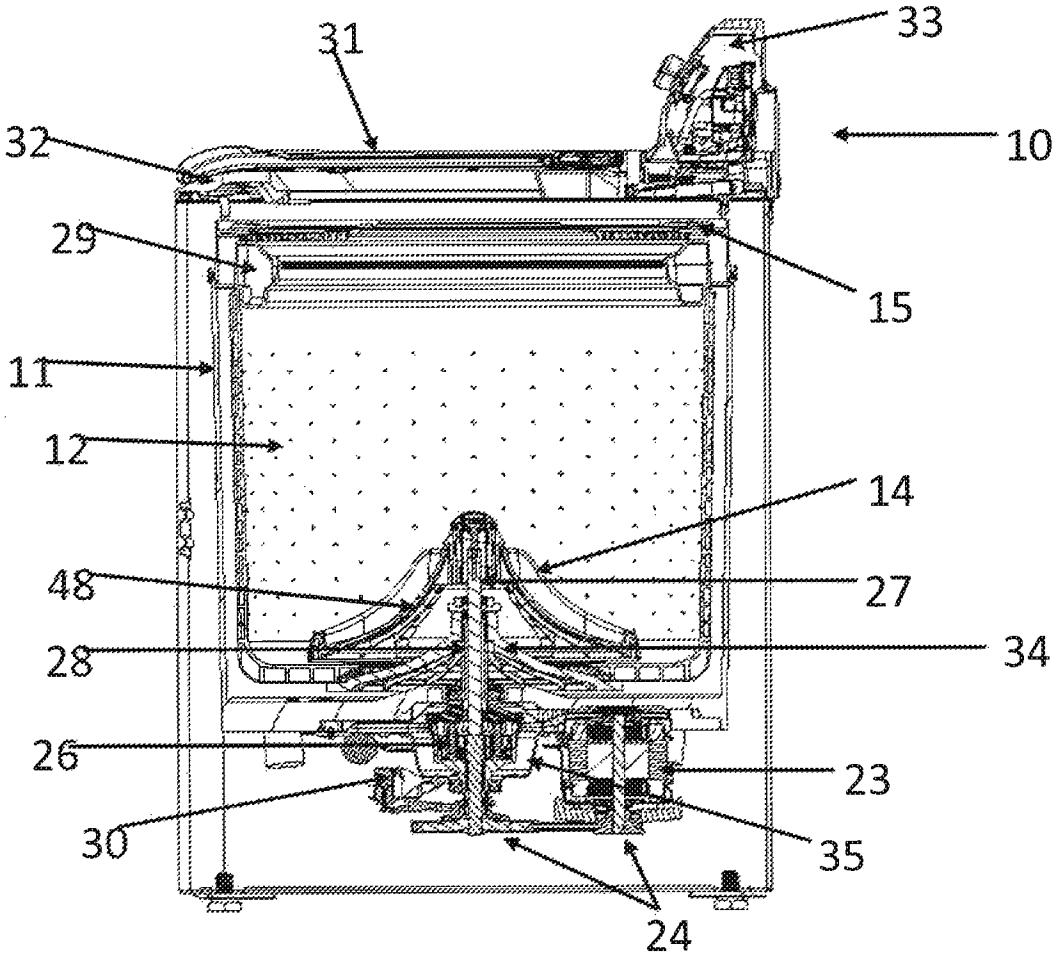
FIG. 2 is a lateral view of a cross cut of an automatic top loading washing machine for clothes.
Figure 3:
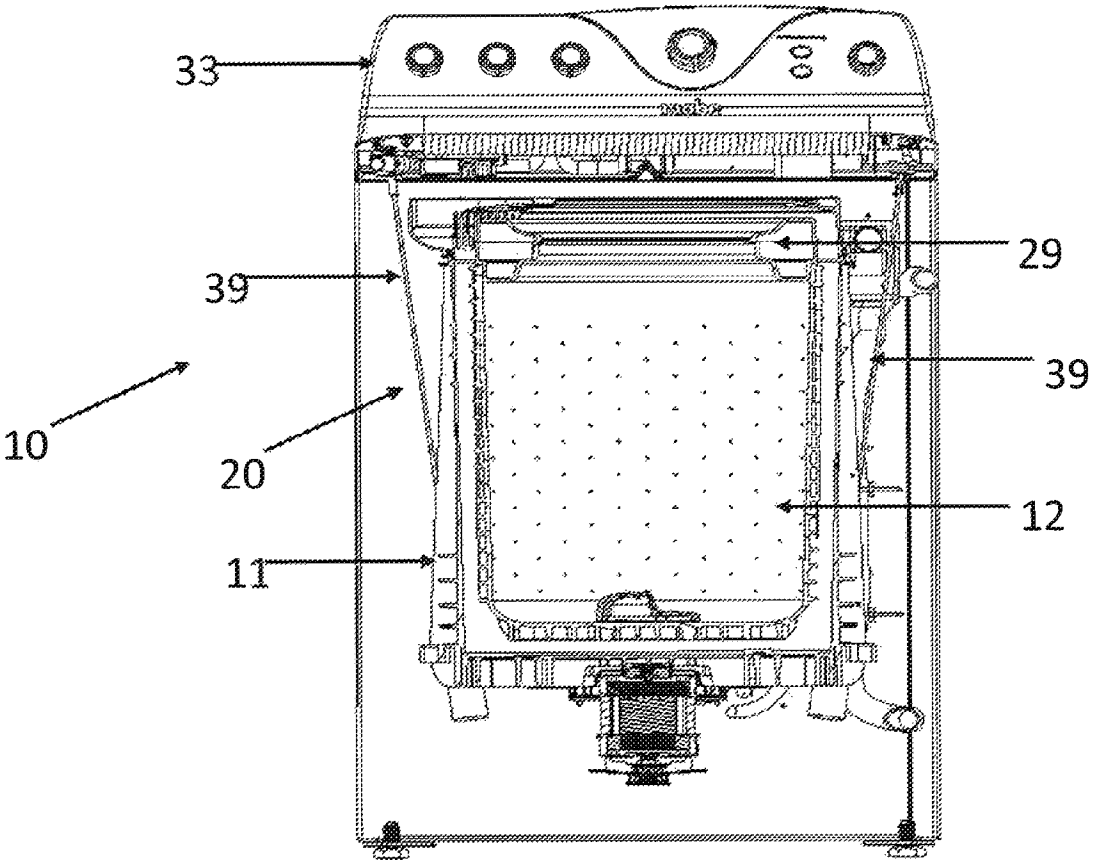
FIG. 3 is a front view of a cross cut of an automatic top loading washing machine for clothes where some of the rods which make up the suspension rod set are shown.
Figure 4:
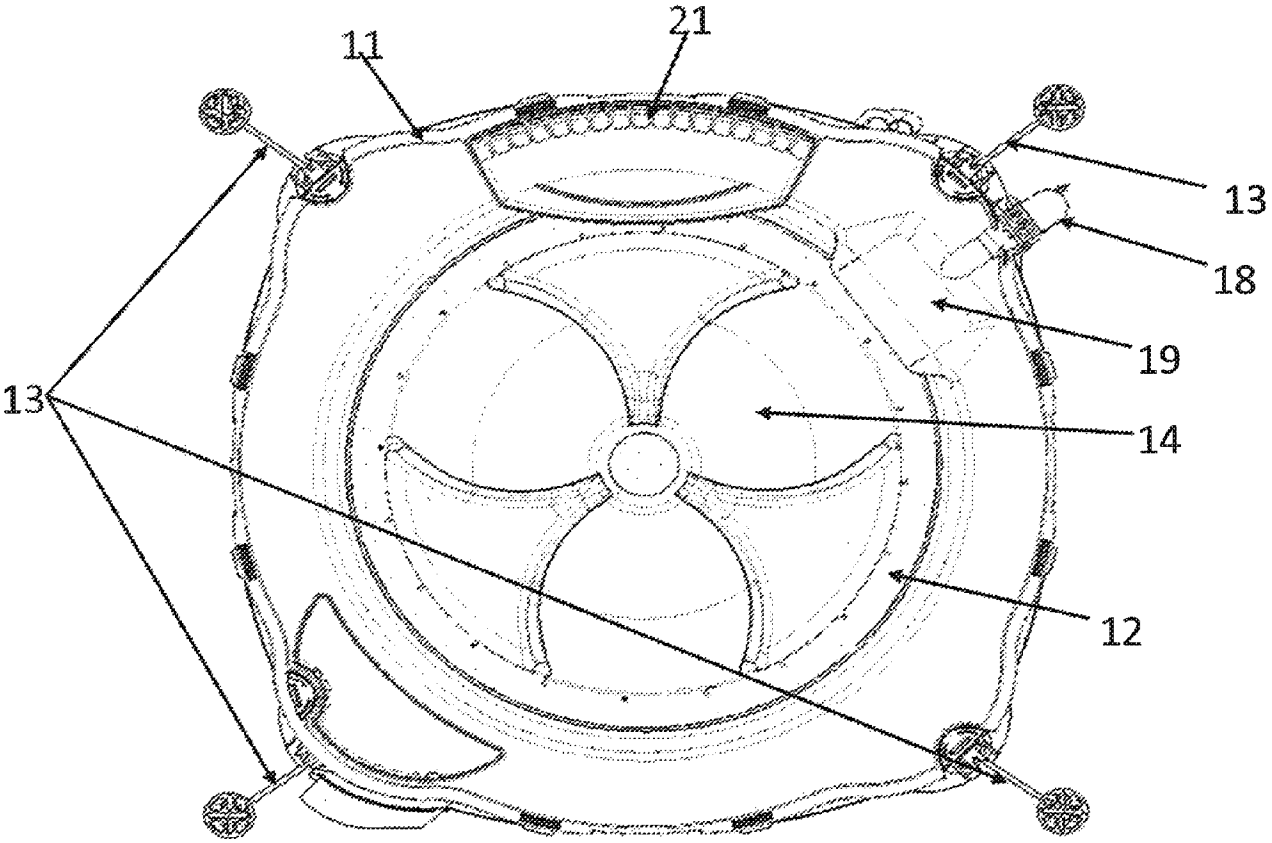
FIG. 4 is an upper view of the sub-washer of an automatic top loading washing machine for clothes where the rod suspension set, the grill and the spray deflector are highlighted.

The washing machine 10 illustrated in FIGS. 1, 2, 3 is the top loading or vertical axis type, and thus it comprises a cabinet 41 from which is fastened the set of suspension rods 39; said set of suspension rods 39 support the weight of the tub 11 along with the remainder of its accessories of said cabinet 41, in addition to acting as a damper to the vibrations which are originated during the washing process. Thus, the tub 11 is hung from said set of suspension rods 39 by means of ears set on the lower part of said tub 11 as can be seen in FIG. 4. On said tub 11 the remaining peripheral equipment is mounted unto, such as the motor 23, optionally a planetary gear for reduction 26, which in an alternative embodiment to the present invention can be omitted, adjusting the relation to the pulleys 24, that is, the pulley with the greatest diameter shall be adjusted over the inner shaft 27, which itself shall receive energy from the electric motor 23 thanks to the pulley arrangement 24 and the band (not shown); optionally, the shaft 27 on its upper end is coupled to a planetary gear 26 with the end goal of decreasing angular velocity and thus obtain greater torque, the exit shaft of the planetary gear 26 is reintegrated into a shaft 27, which on its upper end seats the agitator 48; optionally, the inner shaft 27 on its lower end has the pulley 24 with the greatest diameter coupled unto it and on its upper end has the agitator 48 coupled unto it. The hollow shaft 28 houses in its inner part the inner shaft 27, additionally said hollow shaft 28 is mechanically coupled to a clutch 30 which can cause both shafts 27, 28 rotate together or in an independent manner; said hollow shaft 28 is mechanically coupled to the center of the basket or to the "hub" 34, so that when said shafts 27, 28 are clutched rotating together, the hollow shaft 28 will transmit energy to the basket 12 so that it may turn with the agitator 48.

The basket 12 is crowned with a balance hoop 29 which counteracts the unbalancing caused by the rearranging of the objects to be washed within the basket 12. The tub 11 on the other hand, has on its upper end a tub cover 15 assembled unto it, which houses a grill 21, as well as a spray deflector 19, both illustrated in FIG. 4. On the other hand, the cabinet 41 is sheltered by the main cover 32 which covers the upper part of the washing machine 10; said main cover 32 serves as a support for a crest 33 where the electronic components are housed, such as the electronic control 40, drivers (not shown), pressure switch (not shown), filling valves 37 etc., as well as the door or wash cover lid 31 through which the objects to be washed are introduced. The additive dispenser 60 of the present invention is mechanically connected to the inner part of the main cover 32 of the washing machine 10, preferably by means of screws.

Figure 5:
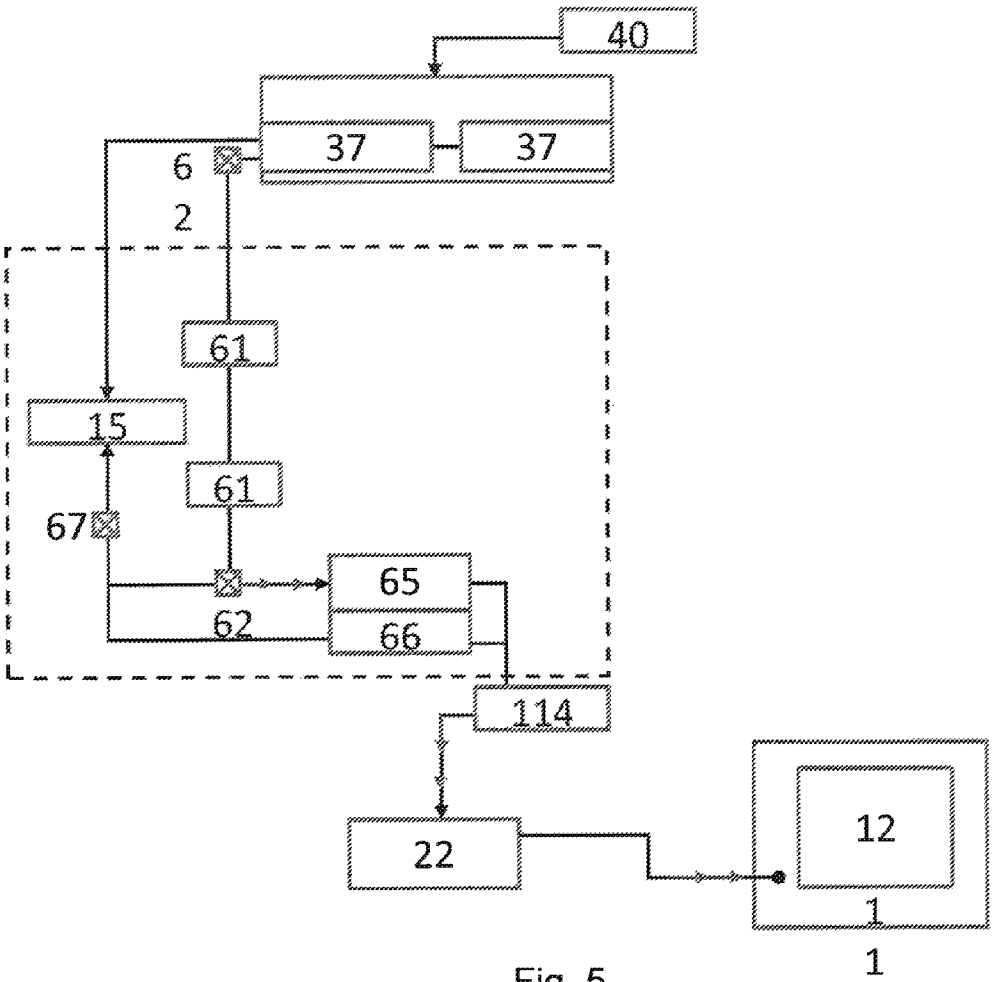
FIG. 5 shows a code diagram of the functioning of the additive dispenser of present invention.

FIG. 5 shows a schematic diagram of the electronic control connection 40 to the additive dispenser parts 60 which it controls.

Figure 6:
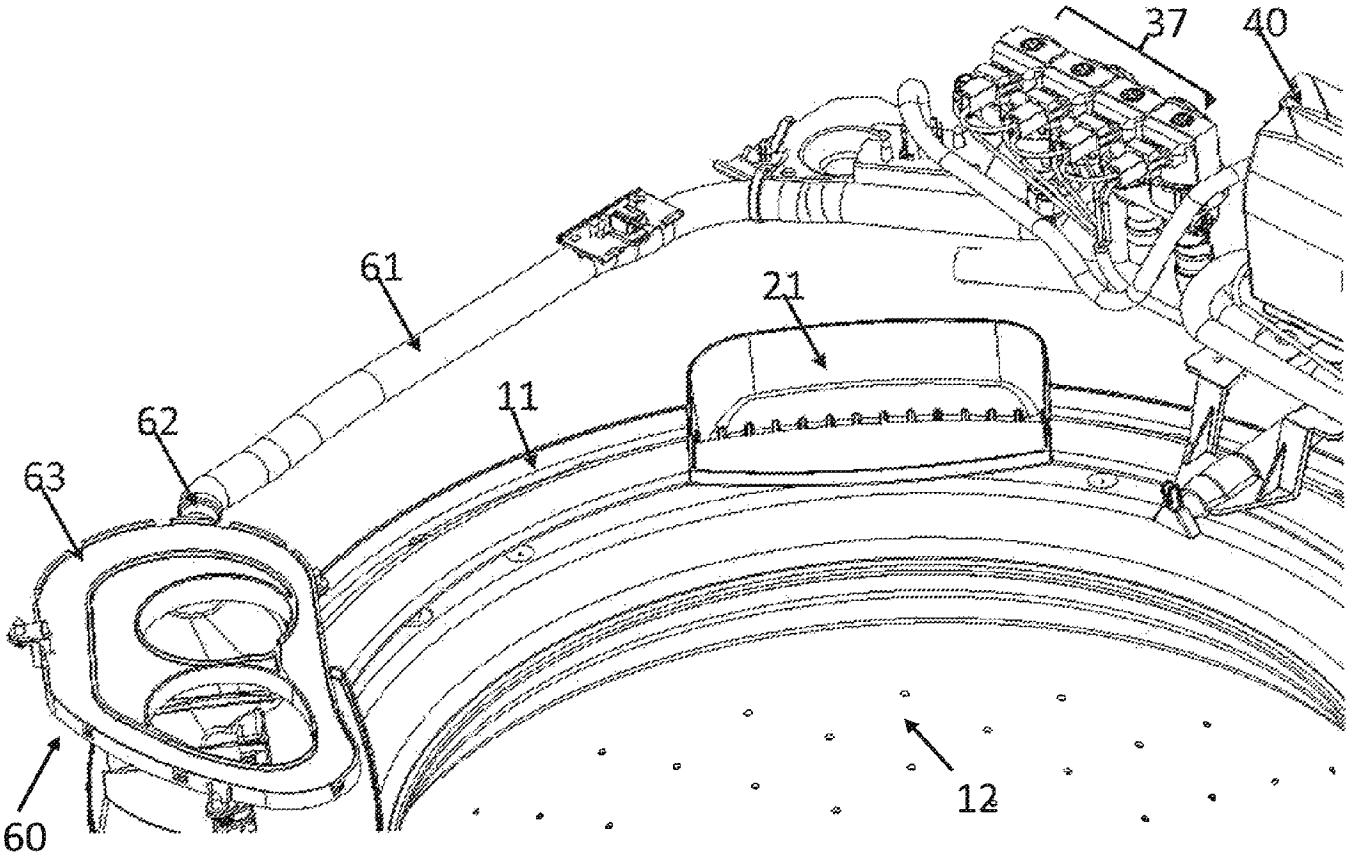
FIG. 6 is an isometric view of the connection between the additive dispenser of the present invention to the supply hose in connection with the filling and electronic control valves.
Figure 7:
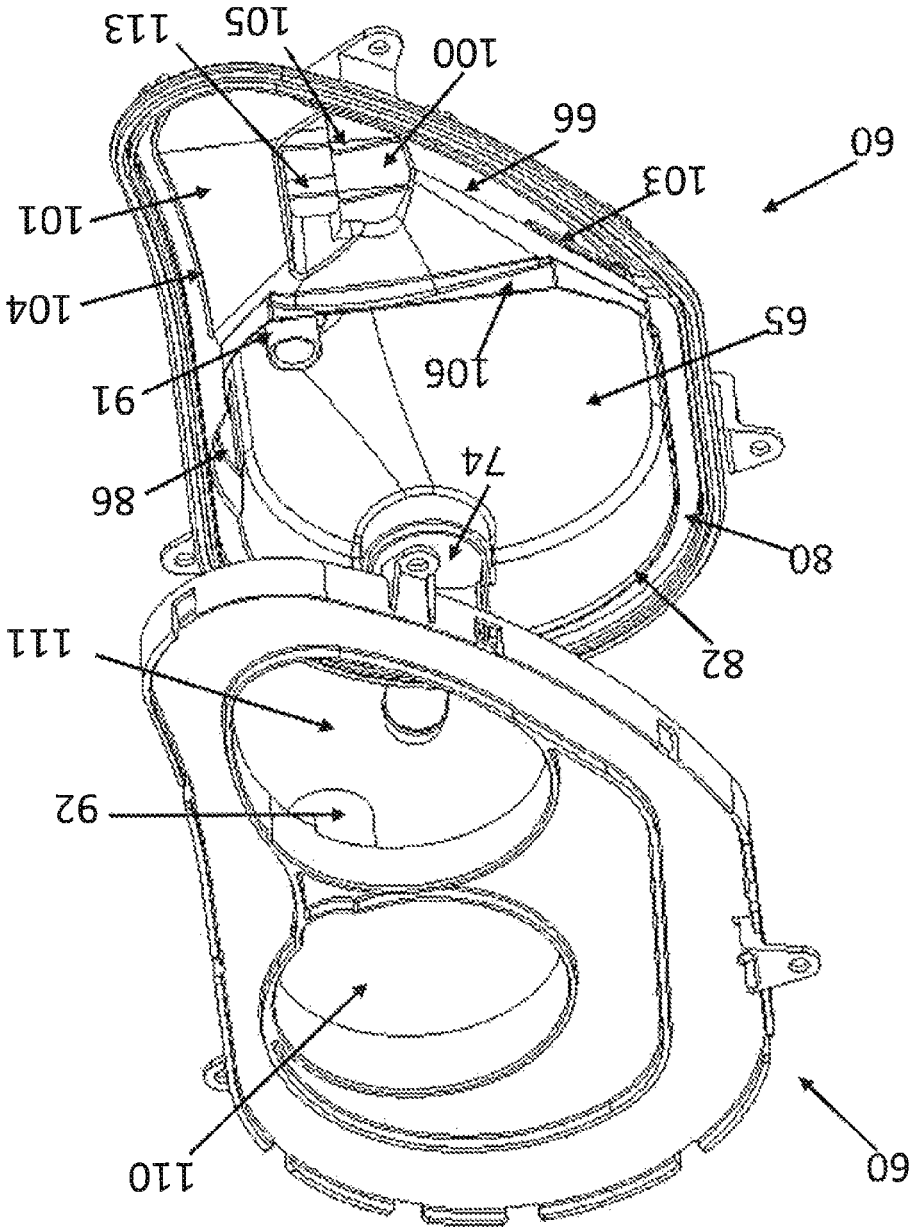
FIG. 7 is an isometric view of the additive dispenser of the present invention in its preferred embodiment.
Figure 8:
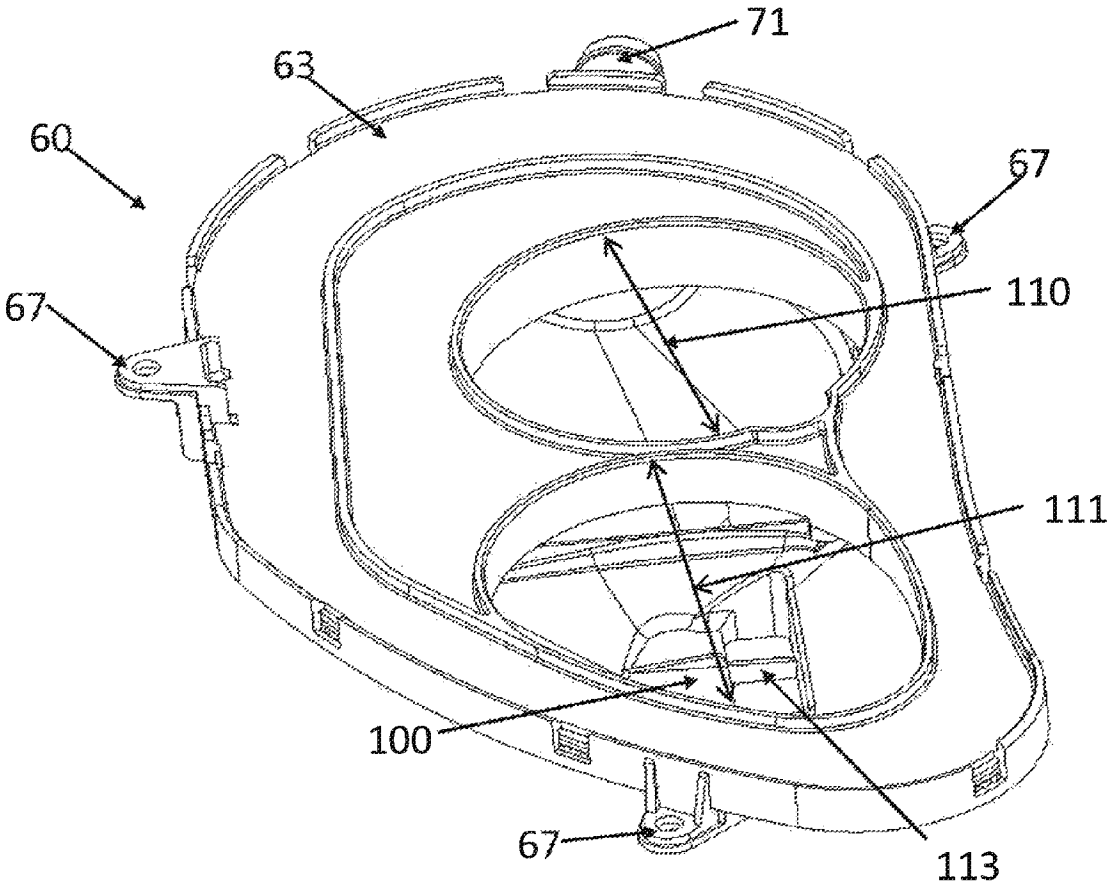
FIG. 8 is an isometric view of the assembly of the cover and the container of the additive dispenser of the present invention in its preferred embodiment highlighting the holes through which the additive is deposited.
Figure 9:
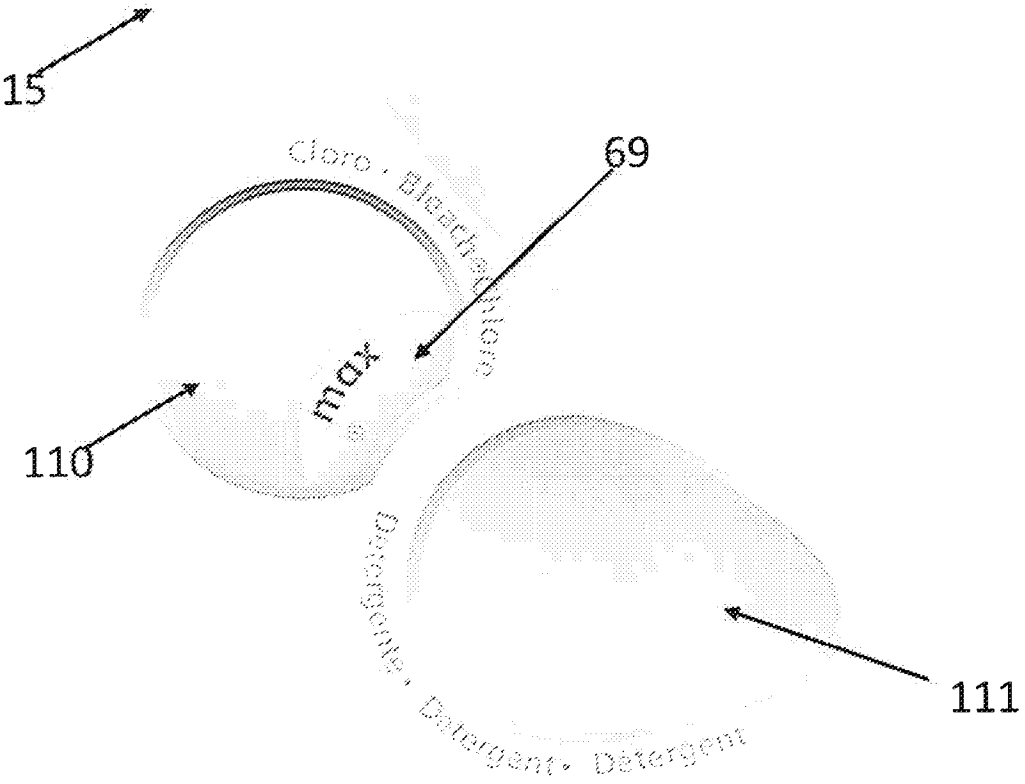
FIG. 9 is an upper view of the maximum level indicator of the additive dispenser of the present invention in its preferred embodiment, which forms part of the main cover lid of the washing machine.

The electronic control 40 sends a pulse for a determined period of time to the driver of the filling valves (not shown) to energize and activate the filling valves 37, allowing for the passage of a volume of wash water which is herded in the direction of the additive dispenser 60 through which a supply hose 61 which is connected to the entrance of said filling valves 37 and fastened to said filling valves 37 by means of a backwards clasp 62, which itself is connected on the other end to the connection nozzle 71 of the additive dispenser 60 and fastened to said connection nozzle 71 by means of a frontal clasp 77 as is detailed in FIG. 6. FIGS. 7, 8 show the additive dispenser 60, of the present invention which is composed in its preferred embodiment with two pieces which are the cover 63 and the container 64 preferably molded by some thermoplastic injection preferably joined by a plastic joining method such as adhesive, hot plate, ultrasound, welding, pressure closure, snaps among others, or a combination of the same, to be careful with the joining between the cover 63 and the container 64, knowing that it is not preferable to have leaks in said joint as this could run the risk of causing that around the washing machine 10 a water puddle can be formed exposing the user to electric discharges given that said leaks mainly present themselves when the dispensers operate at high pressures, which is the case with the additive dispenser 60, of the present invention, which is also designed to work under high pressures. Additionally, a maximum level indicator 69 has been included as is shown in FIG. 9 which forms part of any main cover 32 of washing machine 10, given that as studies show that when this type of indicator 69 is missing, it can cause some users to use a larger amount of detergent or chemical product than that which is recommended by the manufacturer, which prompts or leads to improper functioning of the additive dispenser 60 of the present invention. Particularly in cases where dispensation is carried out by means of a siphon system 90, given that the excess of additives causes the siphon system 90 be activated prior to its time, which in turn causes over-foaming or residue problems in the garments to be washed.

Figure 10:
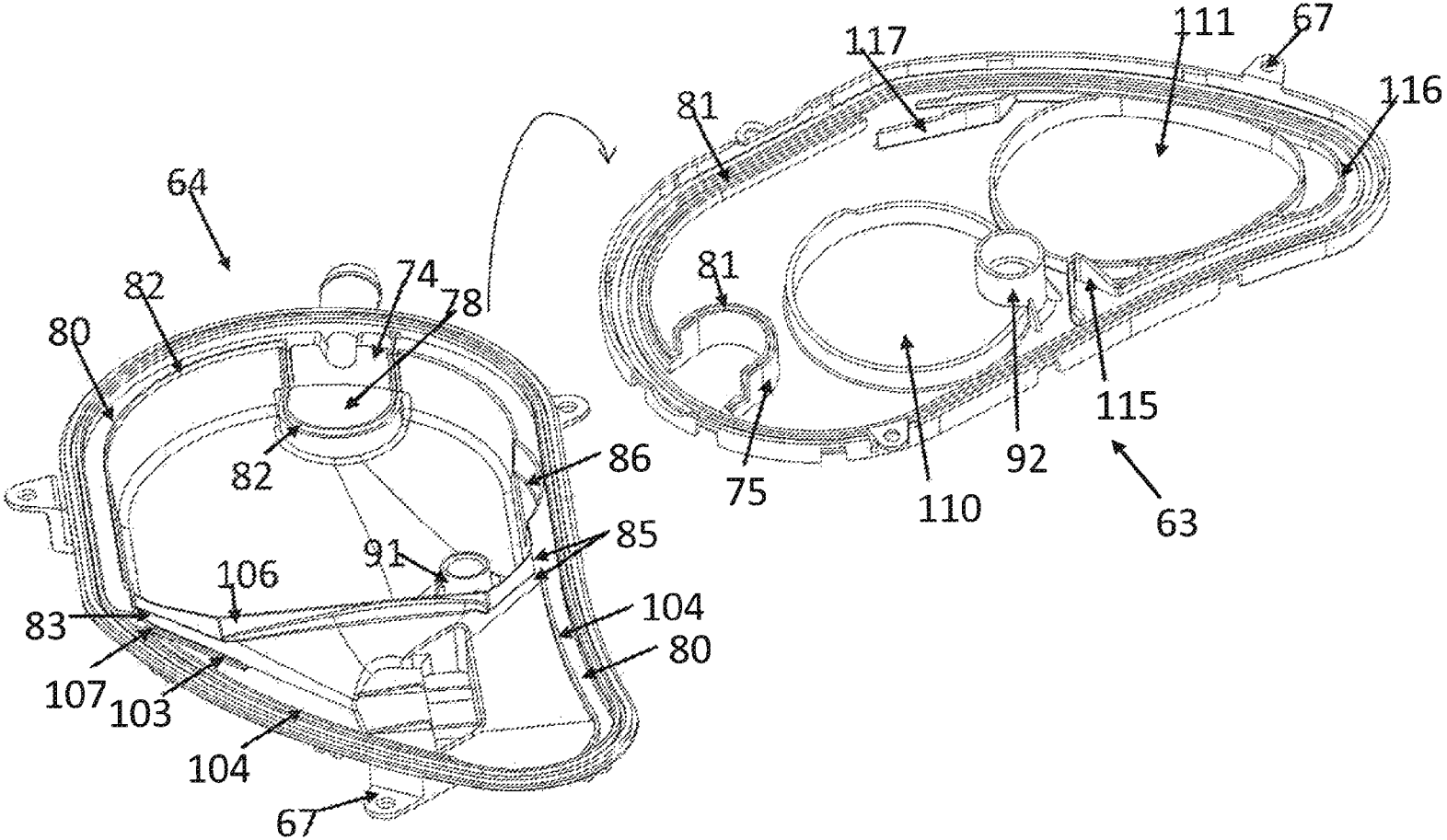
FIG. 10 is an exploded view of the additive dispenser where the cover lid and the container of said additive dispenser in its preferred embodiment, as well as some of its parts are highlighted.

Present invention in its preferred embodiment comprises two deposits 65, 66 for the dosing of wash additives as is shown in FIG. 10, one deposit is for the bleach 65 and the other for detergent 66 with the peculiarity of one water entrance for sweeping the additive for both deposits 65, 66.

This is so that in order to work with a same wash water flow pressure independently from the pressure which it has going through the supply hose 61 knowing that in practice it is considered as a low work pressure starting from 20.68 kPa (3 psi) and up to 82.74 kPa (12 psi) is considered as high work pressure, so that to the additive dispenser 69 of the present invention, a flow homogenizing system 70 has been included, with the end goal that the additive dispenser 60 may work efficiently both for low pressures as well as with high pressures. Said flow homogenizing system 70 is composed in the first place by a connection nozzle 71 which also in addition to allow the connection to the supply hose 61, fastens said connection nozzle 71 by means of a frontal clasp 77, where the referred connection nozzle 71 allows modifying the wash water flow velocity with which it is travelling, thanks to its inner part having a truncated cone shape with the intention of varying the passage area entrance of the additive dispenser 60, thus increasing the velocity at which the wash water arrives, in such a way that the greater diameter end 72 of the referred to connection nozzle 71 is located near the supply hose 61 and distant from the inner part of the additive dispenser, and where through the other side of the lesser diameter end 73 consequently, is located near the inner part of the additive dispenser 60 and distant from the supply hose 61. Additionally, together with the connection nozzle 71, immediately after the smaller diameter end 73, a segment is found neck shaped 76 which directs the wash water flow towards the next element of the flow homogenizing system 70 of the additive dispenser 60.

A damping tank 74 has been included as part of the flow homogenizing system 70 with the objective of dissipating the kinetic energy which was gained by the wash water flow, as a consequence of increased velocity which it acquires upon passing through the inner part of the connection nozzle 71 thus functioning in a hydraulic jump manner, knowing that the hydraulic jump is a sharp rise of the water level in a channel or in a container space as a consequence of the delay which a water current suffers when it flows at a high velocity causing a dissipation of kinetic energy. In the case of the flow homogenizing system 70 of the additive dispenser 60 the hydraulic jump is produced by the damping tank 74 in charge of dissipating the kinetic energy of the wash water flow after having passed through the inner part of the connection nozzle 71, in such a way that said damping tank 74 is an enclosed space with a semi-circular cross section formed by a lower section called the hydraulic cushion 78 which fits together with an upper section called the damping tank cover lid 75 by means of a coupling joint 81 in the damping tank 74 and a coupling groove 82 as part of the damping tank cover lid 75, as the damping tank 74 is part of the container 64 where in turn the damping tank cover lid 75 forms part of the cover 63 of the additive dispenser 60.

Figure 11:
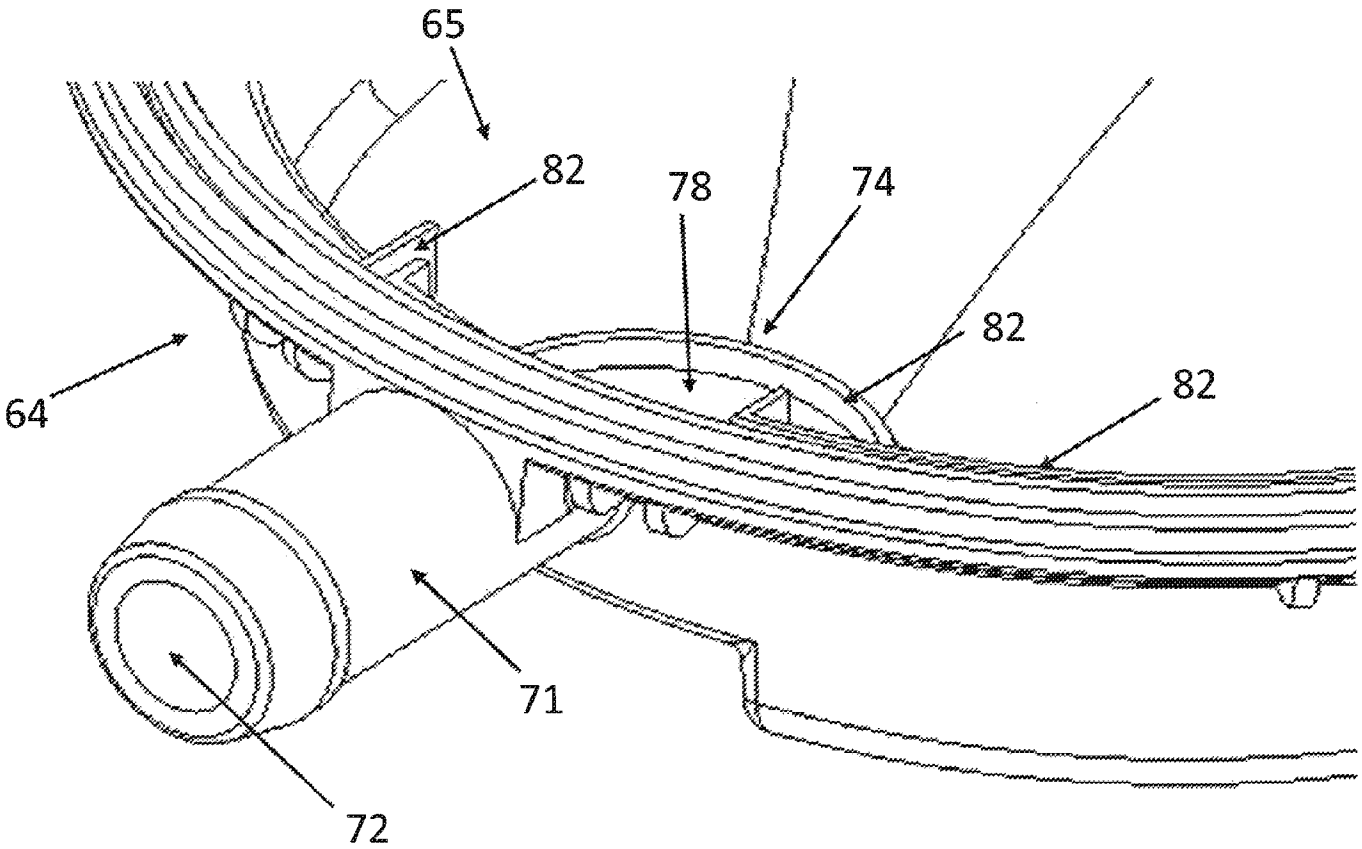
FIG. 11 is an isometric view of the homogenizing flow system located in the container of the additive dispenser, highlighting the connection nozzle and the end with the greater diameter through which the wash water enters into the additive dispenser.
Figure 12:
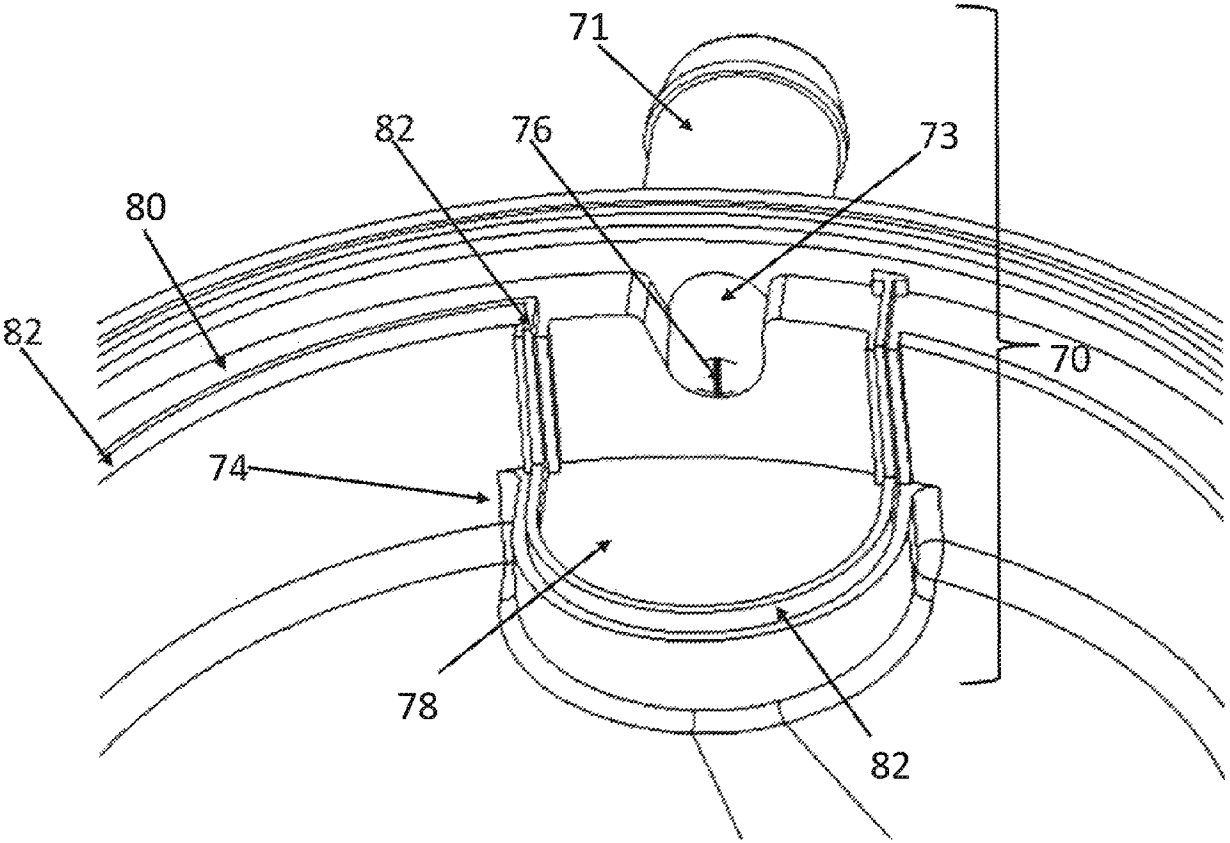
FIG. 12 is an isometric view of the homogenizing flow system highlighting the end with the smaller diameter, the neck, the damping tank and the coupling junction which together with the coupling groove (not visible in this figure) allow for the damping tank to be limited to one area.
Figure 13:
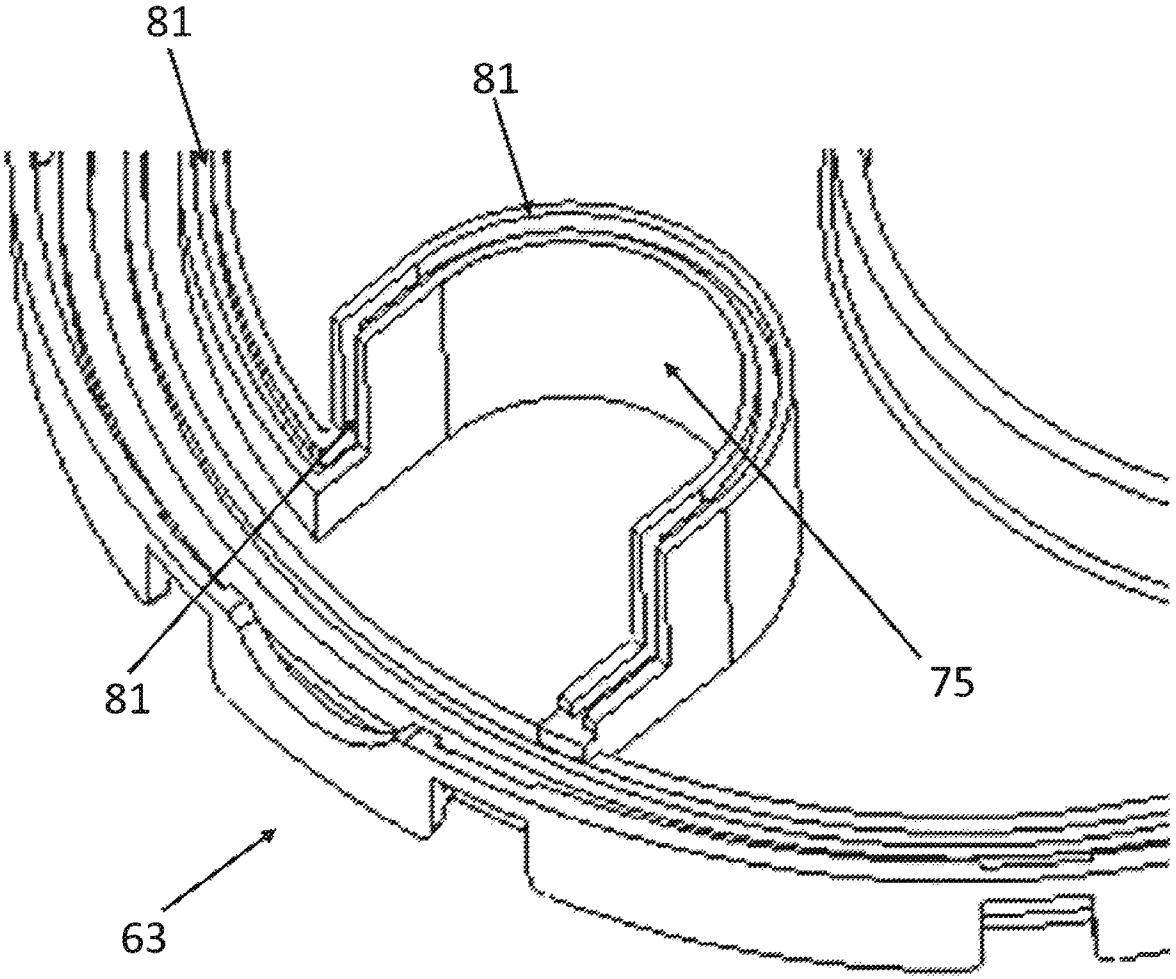
FIG. 13 is an isometric view of a portion of the cover of the additive dispenser of said invention, highlighting the lid of the damping tank which thanks to the coupling groove which it has, they are joined by means of a snap.
Figure 14:
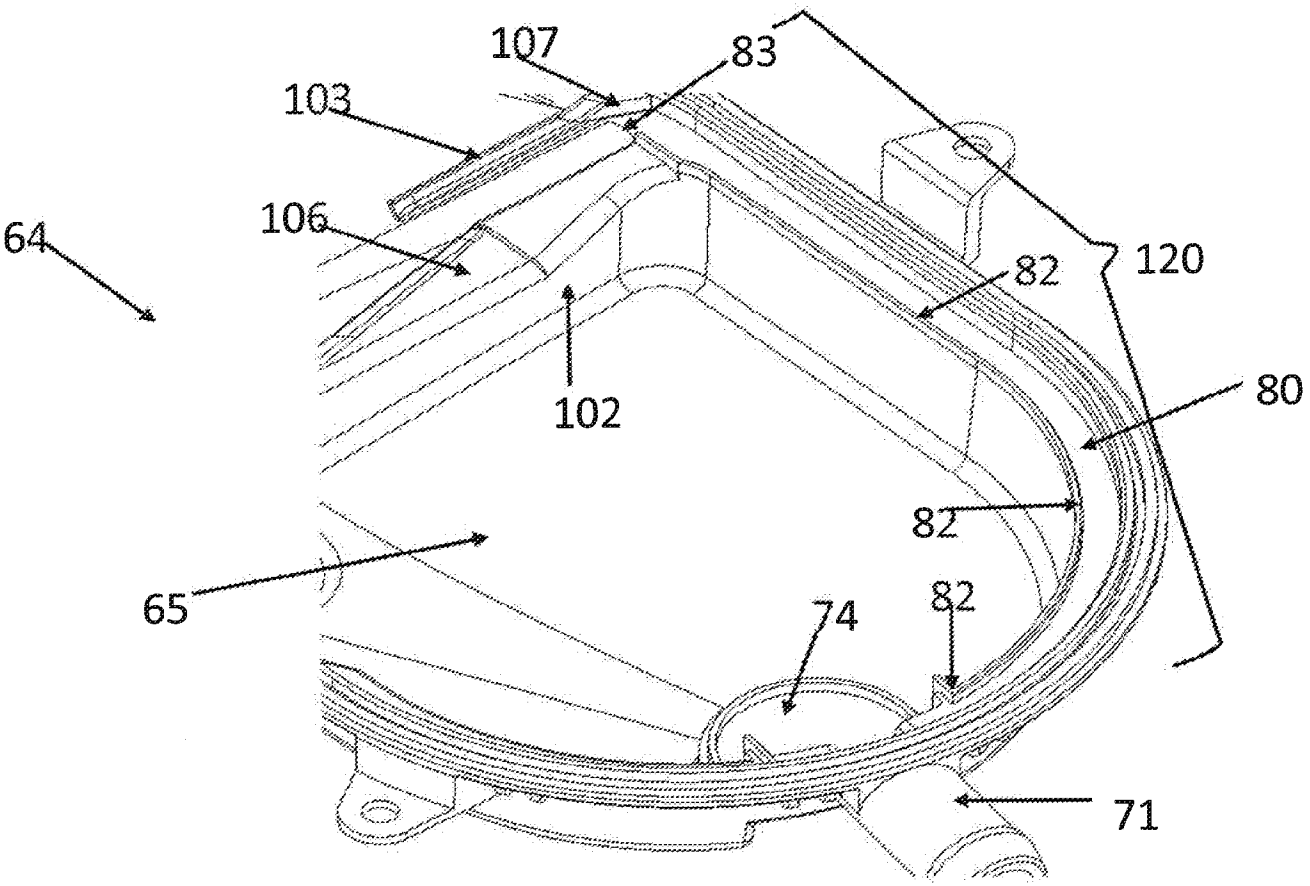
FIG. 14 is an isometric view of the portion of the container of the additive dispenser of the present invention in its preferred embodiment which corresponds to the first section of the additive dispenser of the present invention, highlighting the bleach deposit, the perimeter pathway which is found in fluid communication with the flow homogenizing system and the linear deflector.

In this way, after the wash water has passed through the neck 76, it arrives at the damping tank 74 falling unto the hydraulic cushion 78 where the wash water volume is radially spread acquiring a fast stall speed whereas the height of the wash water increases abruptly, given that the wash water flow passes from having a fast stall speed to having a slow stall speed after having experienced the impact within the damping tank 74. Afterwards, as the height of the wash water increases in the damping tank 74, the wash water acquires its own drafting scheme upon coming into contact with the perimeter pathway 80, where said perimeter pathway 80 is found in fluid communication with the damping tank 74 in such a way that starting from the wash water arriving to said perimeter pathway 80, which is formed by the cover 63 and the container 64, the wash water volume remains with the same flow scheme which will avoid overflowing or in the opposite case, insufficient flow pressure for the correct dispensation of the additives. The elements which make up the flow homogenizing system 70 are shown in FIGS. 11, 12 and 13.

The referred perimeter pathway 80 is a space which runs along the borders of both additive deposits 65, 66 of the additive dispenser 60, in its preferred embodiment, additionally serving as a means through which the wash water is lead towards each one of the referred deposits 65, 66 in such a way that the wash water in the channel is strategically release at certain points through the plurality of deflectors 83, 84, 85 which are formed by the container 64 and the cover 63 which serve to direct the wash water which travels through the referred perimeter pathway 80 towards the inside of the deposits 65, 66 in addition to helping prevent overspills outside the additive dispenser 60.

Figure 15:
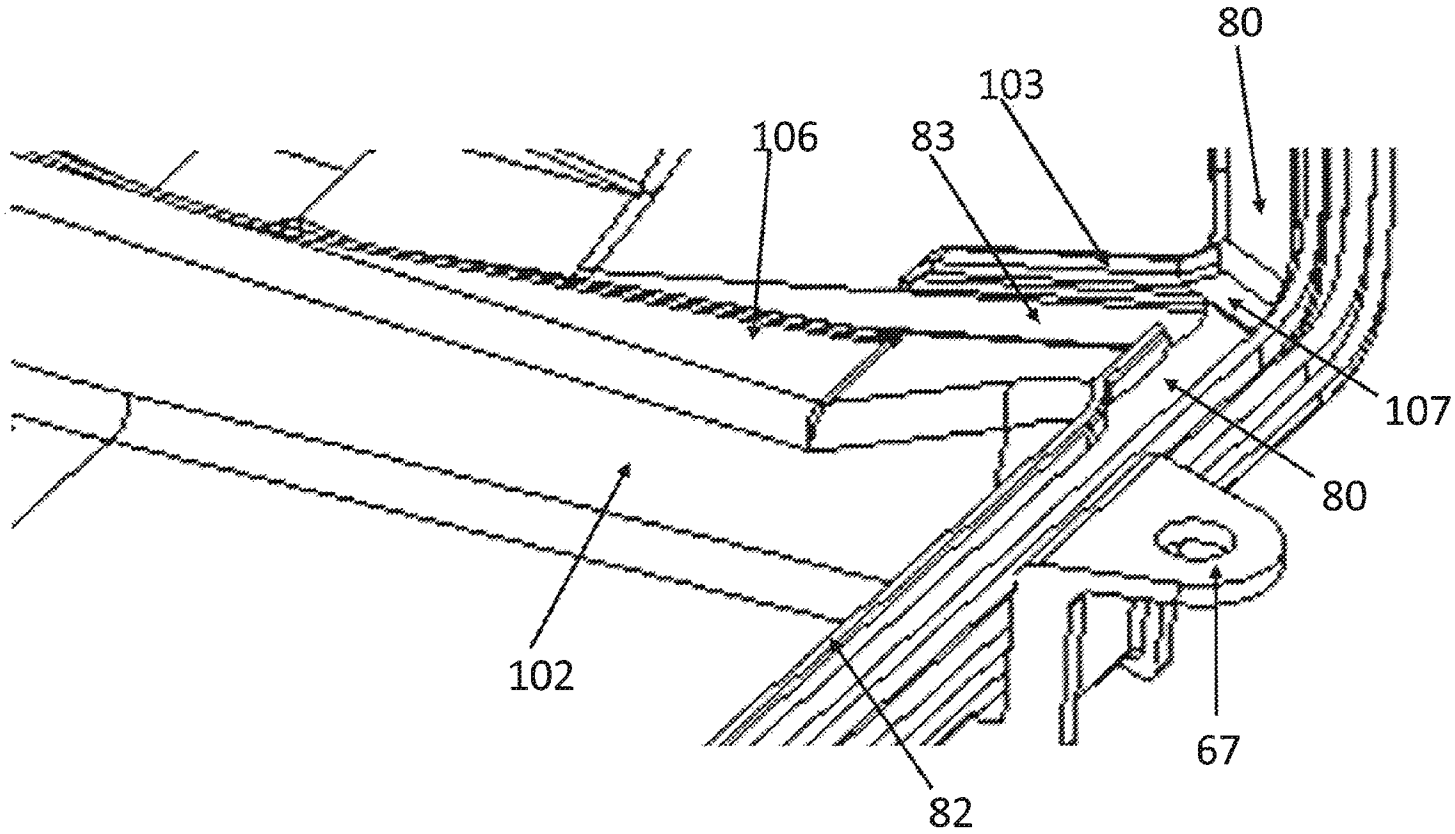
FIG. 15 is an isometric view of a portion of the container of the additive dispenser of the present invention highlighting the linear deflector in fluid communication with the perimeter pathway, the protrusion of the linear deflector and the place presenting a reduction in the passage area of the perimeter pathway; additionally, the dividing wall between the bleach deposit and the detergent deposit with its corresponding slope can be seen.

FIG. 15 presents a first section 120 of the additive dispenser 60 of present invention through which the wash water begins to travel within the perimeter pathway 80 which additionally is delimited in a manner similar to the damping tank 74, by a coupling joint 81 and a coupling groove 82 with the objective that the wash water remains in its course without remaining in the bleach deposit 65, attempting in such a manner that the greatest amount of wash water be used for sweeping the residues of the detergent deposit 66 where the residue is problematic.

Figure 16:
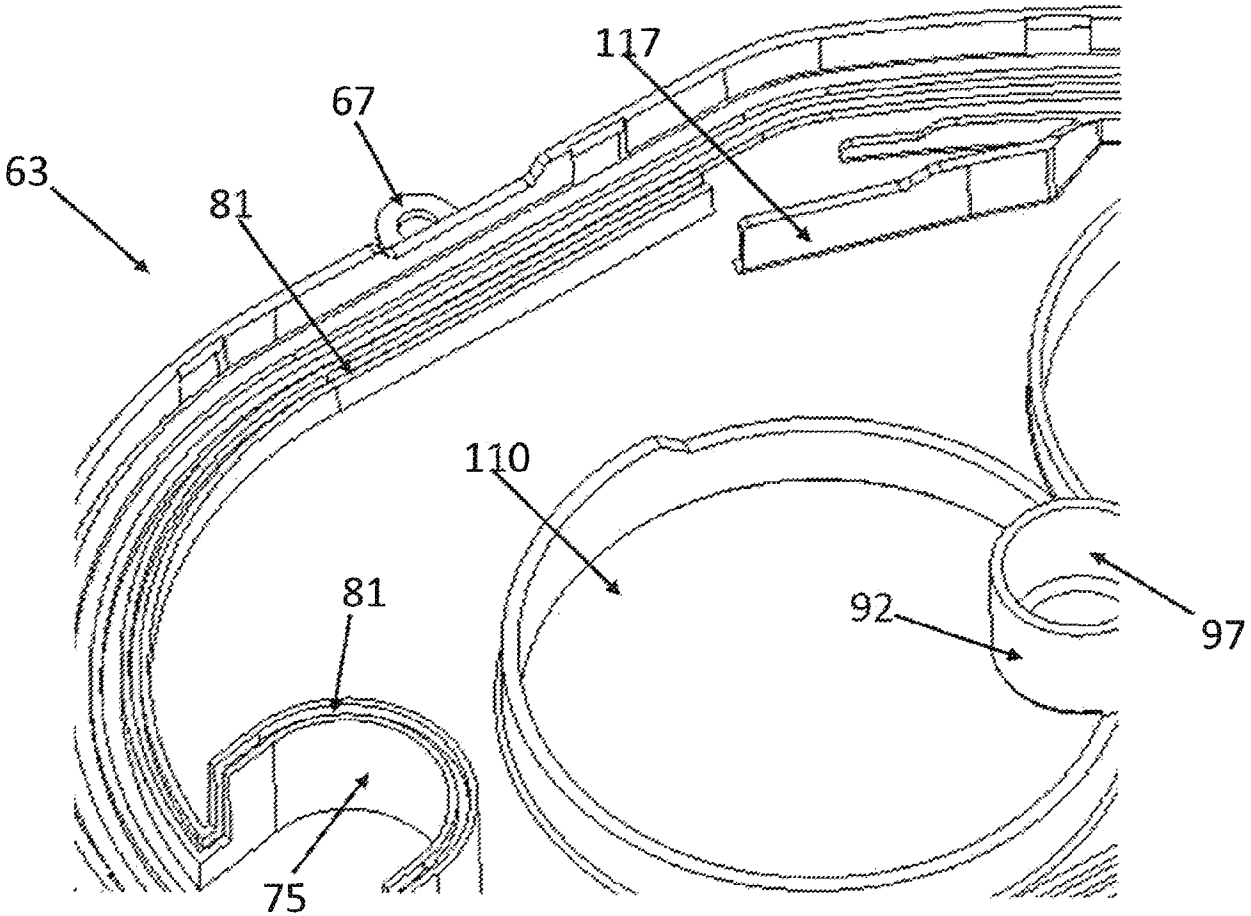
FIG. 16 is an isometric view of a portion of the inner part of the cover of the additive dispenser of the present invention highlighting the upper protrusion of the linear deflector and the coupling groove.

Afterwards, between the first section 120 of the additive dispenser 60 of present invention and a second section 121 of the additive dispenser 60, the first releasing of wash water is undertaken by means of a linear deflector 83 which is formed by a deflection and a protrusion 103 of the linear deflector in the container 64 together with an upper protrusion 117 of the linear deflector which forms part of the cover 63 illustrated in FIGS. 15 and 16 in such a way that the protrusion 103 of the linear deflector of the container 64 eases the redirecting of wash water flow mainly towards the detergent deposit 66. However, between the bleach deposit 65 and the detergent deposit 66 there is a dividing wall 102 whose upper base comprises a slope 106 which at the moment in which the wash water falls through a linear deflector 83, said slope 106 allows a part of that wash water to reach the bleach deposit 65 beginning with the activation of the siphon system 90 which it counts with. As part of the second section 121 of the additive dispenser 60, a protrusion segment 103 of the linear deflector in the container 64 is found in an obstructive manner over the referred perimeter pathway 80, causing a reduction in the passage area 107, with the objective of originating an increase in the wash water flow velocity which remains in the channel of the referred perimeter pathway 80 in order to continue with sufficient pressure to maintain itself in the channel over said perimeter pathway 80. Additionally the segment of perimeter pathway which corresponds to the second section 121 of the additive dispenser 60 of comprises a safety protrusion 104 which ensures the channeling of the wash water towards the next releasing point of the wash water after having crossed the reduced passing area segment 107.

Figure 17:
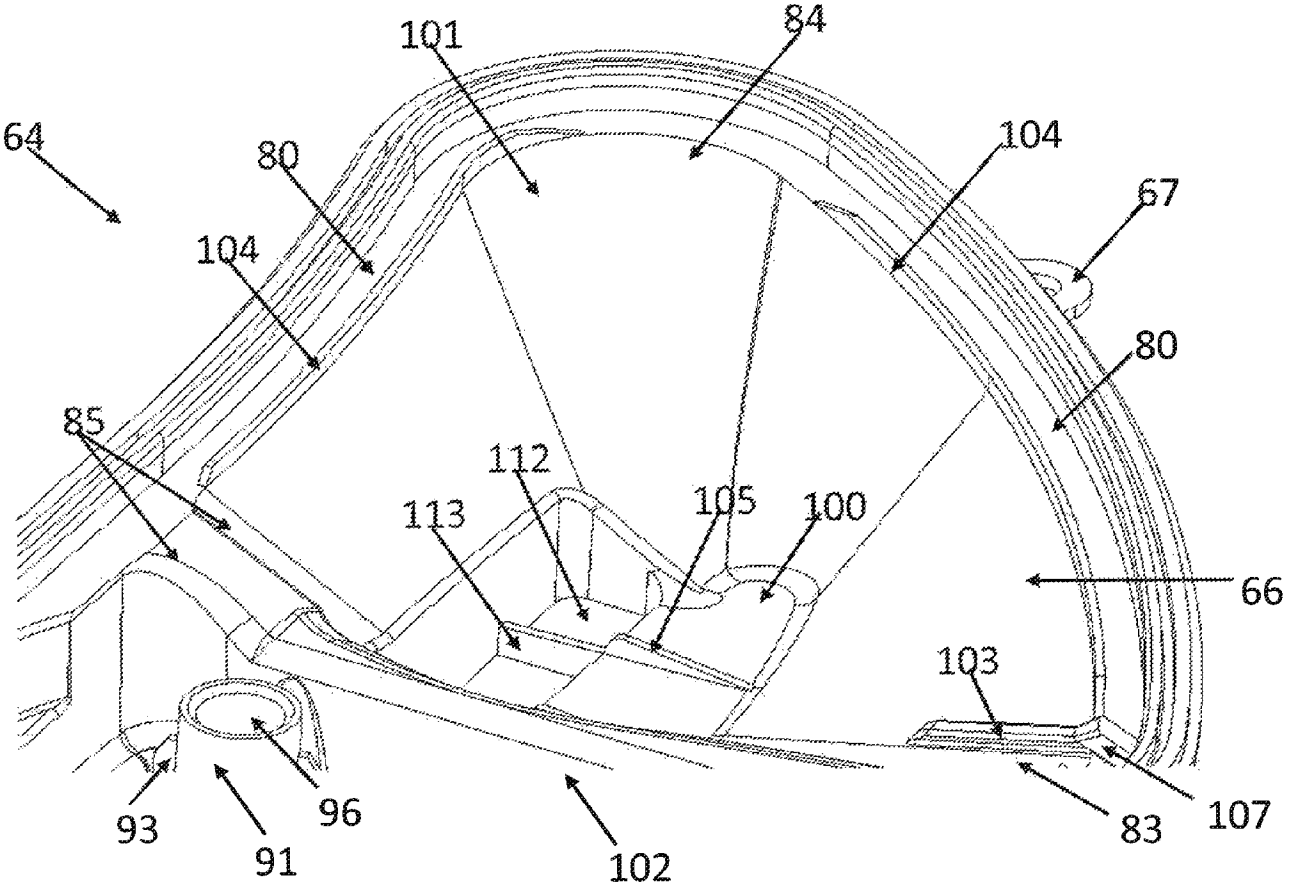
FIG. 17 is an isometric view of a portion of the additive dispenser container of the present invention in its preferred embodiment corresponding to the second section of the additive dispenser of the present invention and to the third section of the additive dispenser of the present invention, highlighting the curved deflector and the bidirectional deflector which are found in fluid communication with the perimeter pathway.
Figure 18:
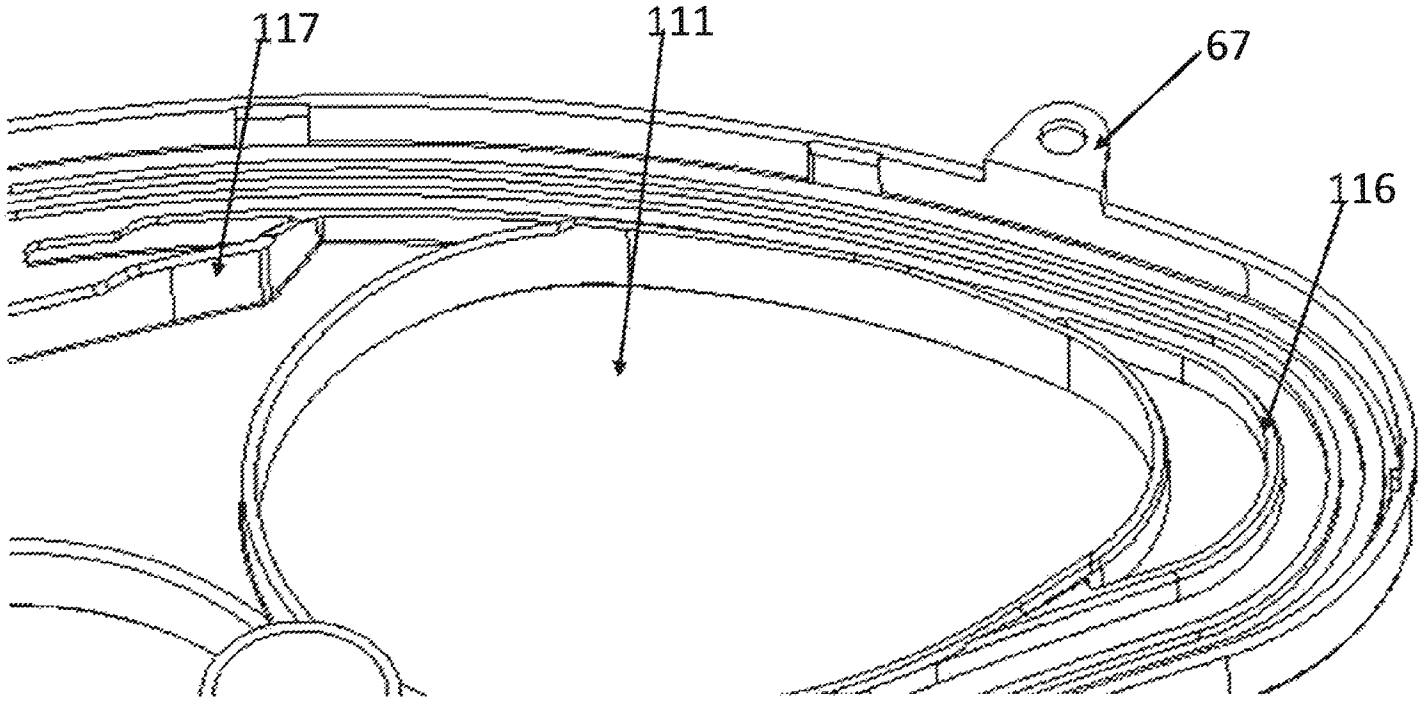
FIG. 18 is an isometric view of a portion of the cover of the additive dispenser of the present invention highlighting the curved protrusion corresponding to the curved deflector located in the container.
Figure 19:
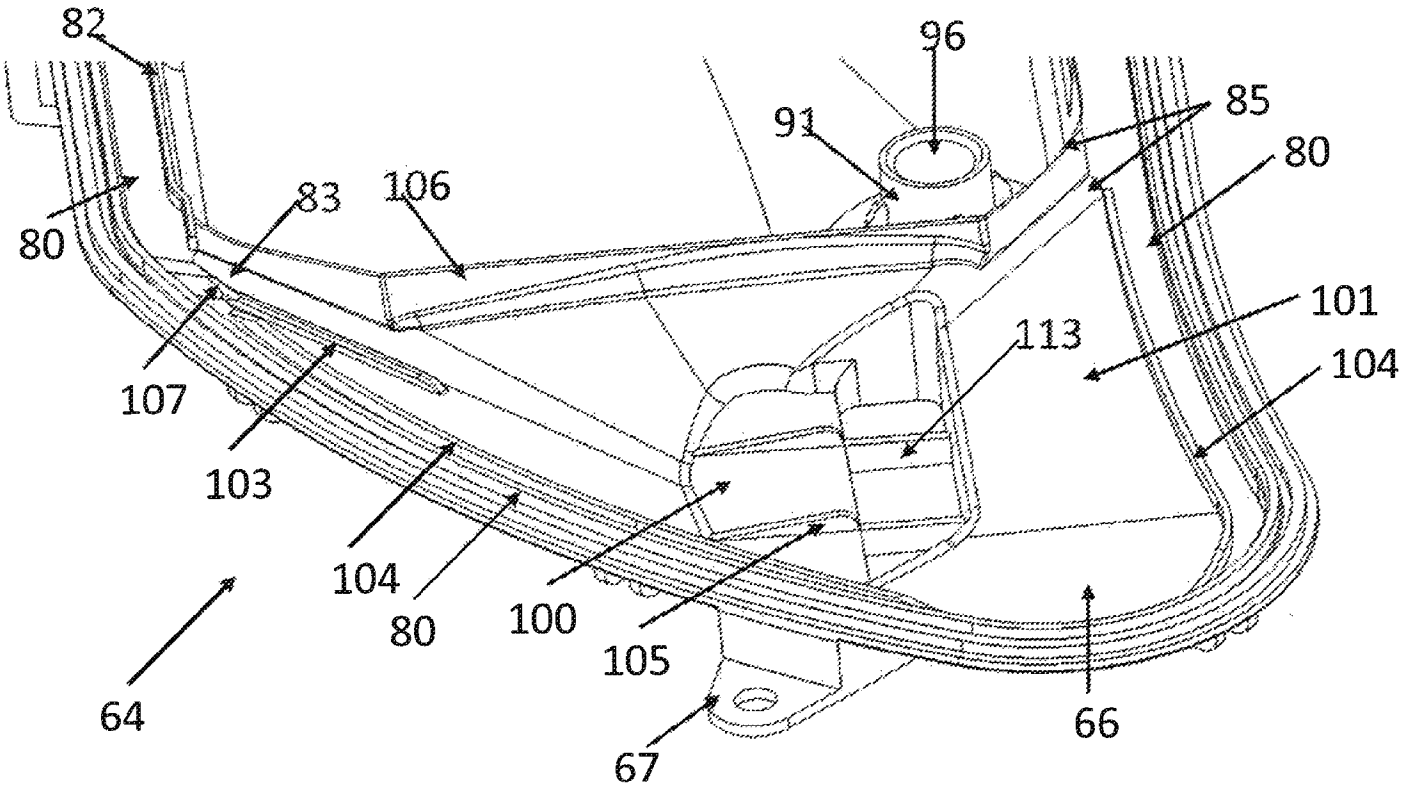
FIG. 19 is an isometric view of a portion of the detergent deposit of the additive dispenser of the present invention highlighting the bay in the detergent deposit, as well as two safety grills in the additive exit which impede the passage of foreign objects.

The second releasing of wash water takes place between the second section 121 of the additive dispenser 60 of present invention as well as the third section 122 of the additive dispenser 60 of the present invention, even within the limits of the detergent deposit 66, by means of a curved deflector 84 as part of the container 64 in conjunction with a curved protrusion 116 which forms part of the cover 63 illustrated in FIGS. 17, 18 and 19. At this releasing point, given the wash water velocity after having crossed the reduced passing area segment 107, it decreases given the referred curved deflector 84 with a re-circulated effect similar to that which can be seen in the water evacuation within a toilet, in such a way that together with the feature which the detergent deposit 66 comprises a downwardly inclined wall 101 which surrounds it, the wash water is released from the curved deflector 84 with a certain degree of turbulence in order to achieve efficient sweeping of residues. In addition to the downwardly inclined wall 101, the detergent deposit 66 comprises a bay 100 at the bottom provided with a group of reinforcement protrusions 105 which maintain their original shape, that is flat and horizontal in such a way that it can store a water film when it is released by means of the curved deflector 84 to ensure that the missing detergent particles be picked up. Nearby the referred bay 100 an exit orifice for the wash liquor 114 of the referred detergent deposit 66 is found, comprising at least one safety grill 113 with the objective of avoiding the passage of foreign objects which could damage the washing machine 10.

Figure 20:
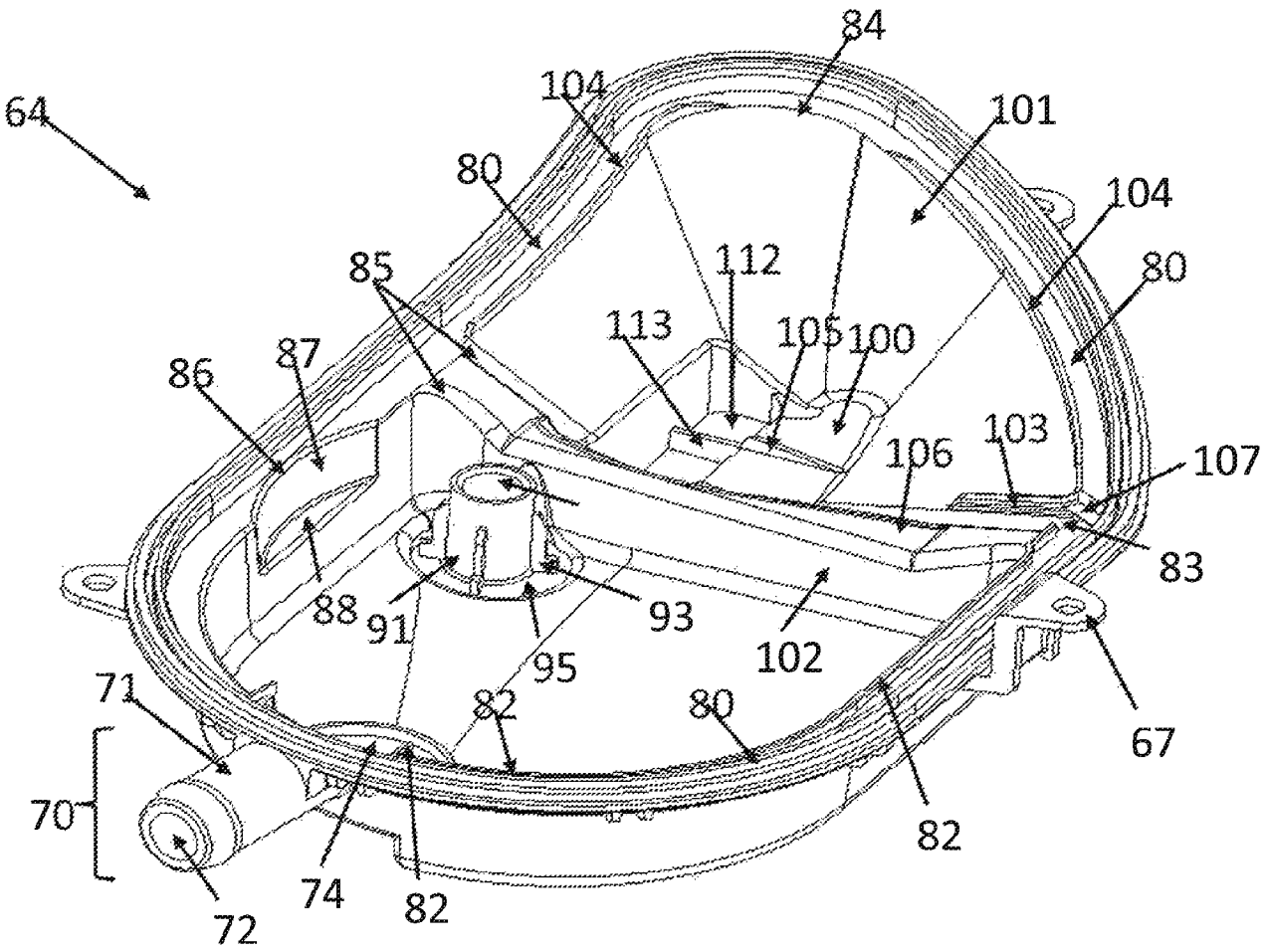
FIG. 20 is an isometric view of the additive dispenser container in its preferred embodiment highlighting the bleach deposit and the detergent deposit.
Figure 21:
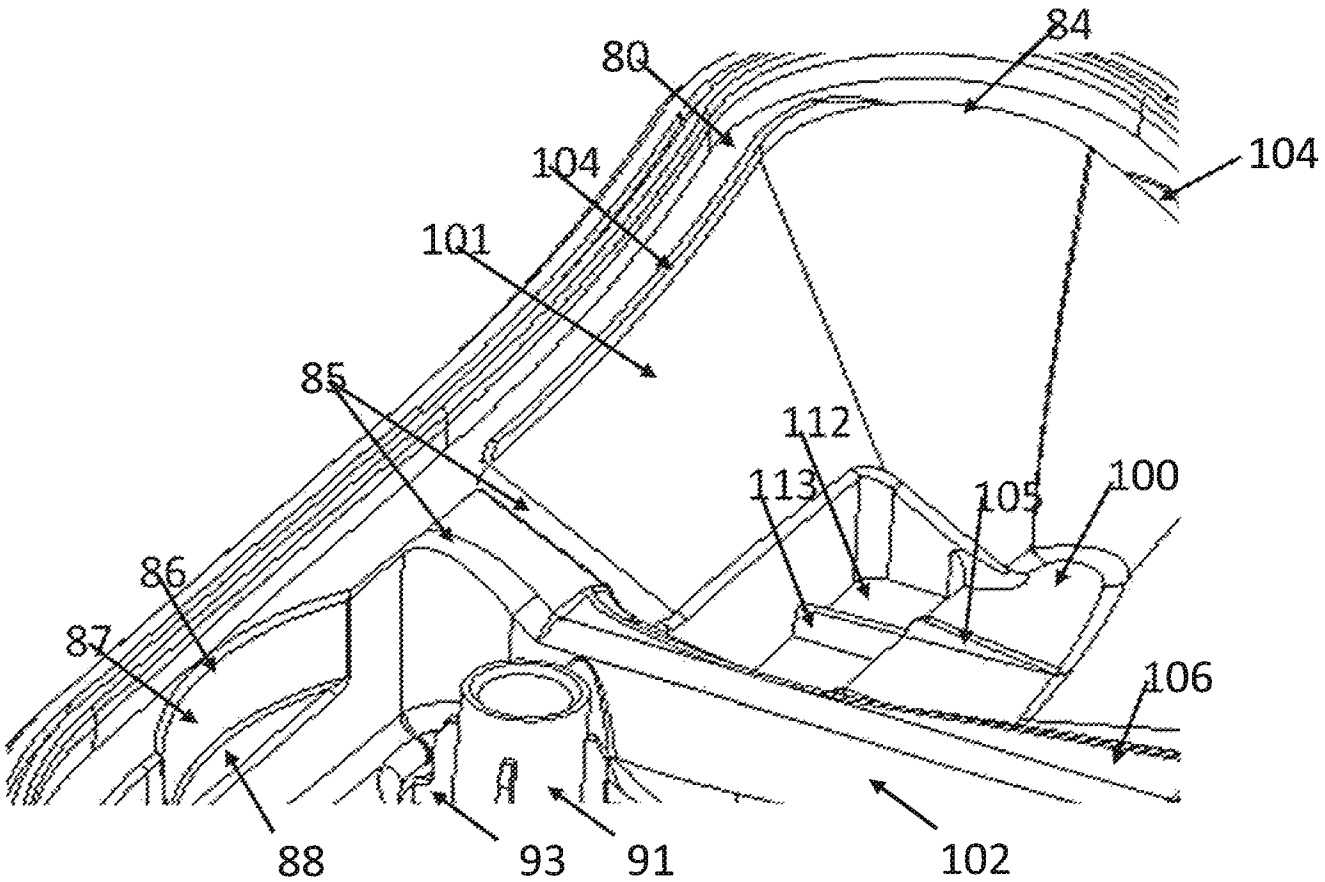
FIG. 21 is an isometric view of a portion of the detergent deposit container of the present invention highlighting the bay in the lower part of the detergent deposit, as well as the curved deflector and the bidirectional deflector in fluid communication with the perimeter pathway.
Figure 22:
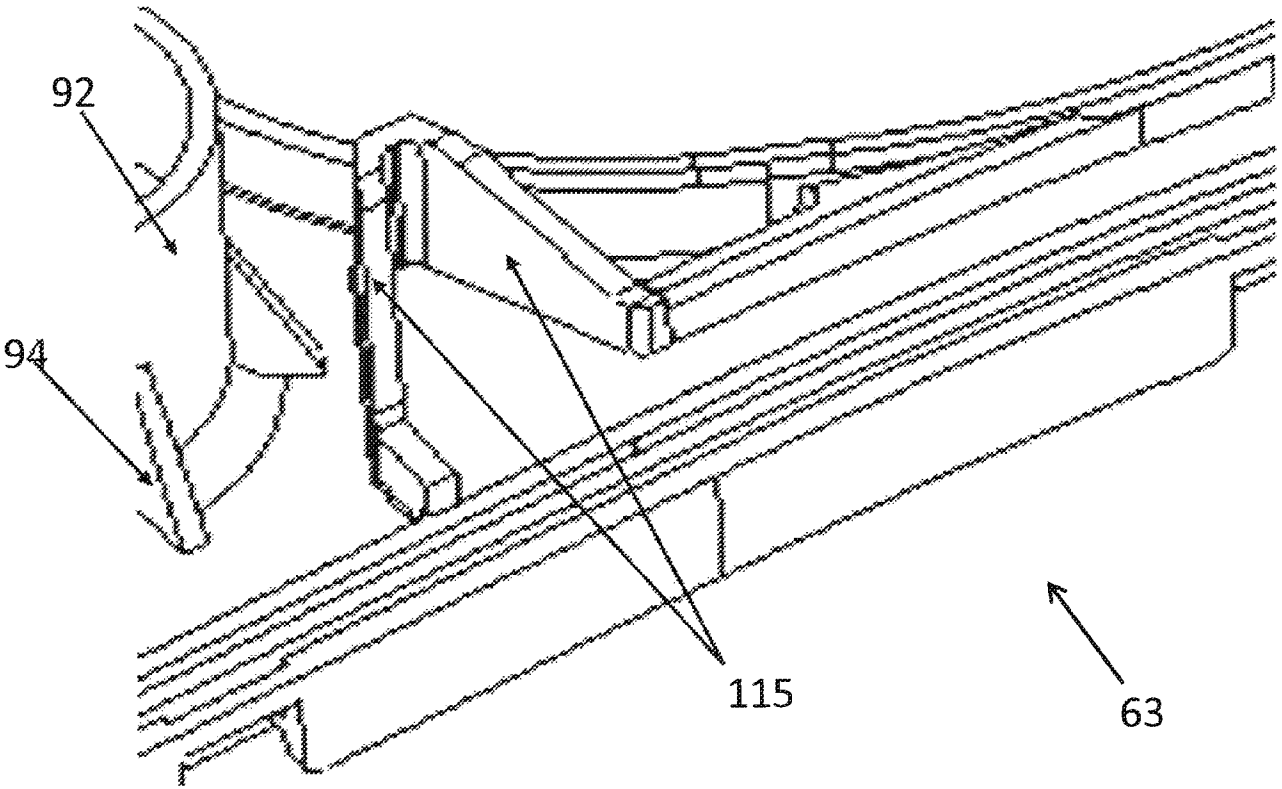
FIG. 22 is an isometric view enhanced at a portion of the cover of the additive dispenser of the present invention in its preferred embodiment, highlighting the protrusion in "V" shape corresponding to the bidirectional deflector located in the container of said additive dispenser.

Subsequently, after the majority of the wash water which is found travelling through the perimeter pathway 80 and which is released by means of the curve deflector 84, the remaining wash water remains in its channel through the perimeter pathway 80, which similar to the second section 121 of the additive dispenser 60 of present invention, it comprises a safety protrusion 104 which allows for the wash water which remains traveling through said perimeter pathway 80, be directed towards the next releasing point, which is through a bidirectional deflector 85 found between the third section 122 of the additive dispenser 60 and the fourth section 123 of the additive dispenser 60, which is formed by the container 64 plus a protrusion in "V" shape 115 found on the cover 63 in such a way that the wash water which remains flowing in the perimeter pathway 80 after having passed through the curved deflector 84, is released dividing itself in two directions, one towards the detergent deposit 66 falling with the same re-circulated effect as the curved deflector 84, thus ensuring the sweeping of possible residues on the remainder of the inclined wall 101 of the detergent deposit 66, and on the other part in the direction towards the bleach deposit 65, where said curved deflector is presented in FIGS. 20, 21 and 22.

Figure 23:
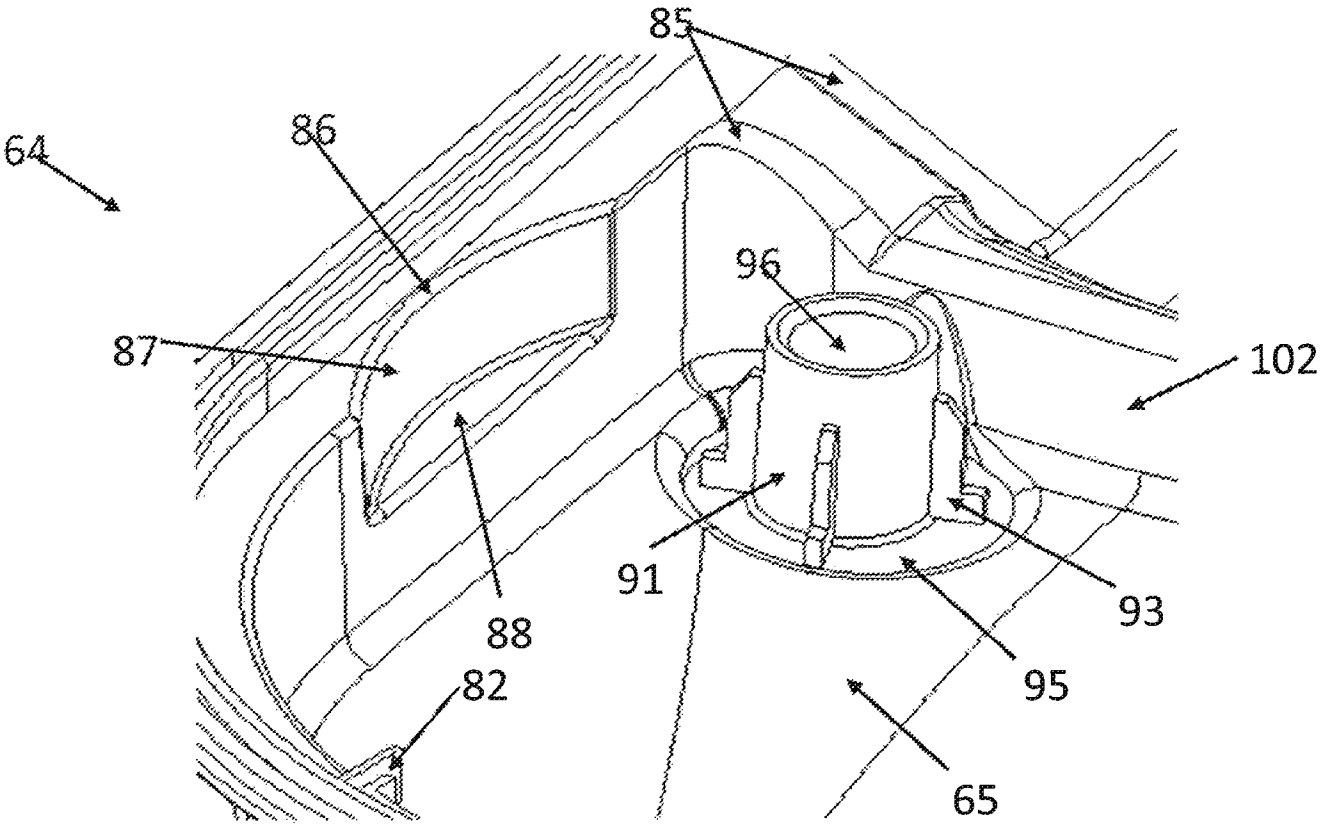
FIG. 23 is an isometric view of a portion of the container of the additive dispenser of the present invention in its preferred embodiment corresponding to the bleach deposit where the lower part of the siphon system which shows the cylindrical body with its corresponding reinforcement ribs on the base and the depression surrounding the cylindrical body of the siphon system are highlighted; additionally, the waterfall which is found in fluid communication with the perimeter pathway can be seen.
Figure 24:
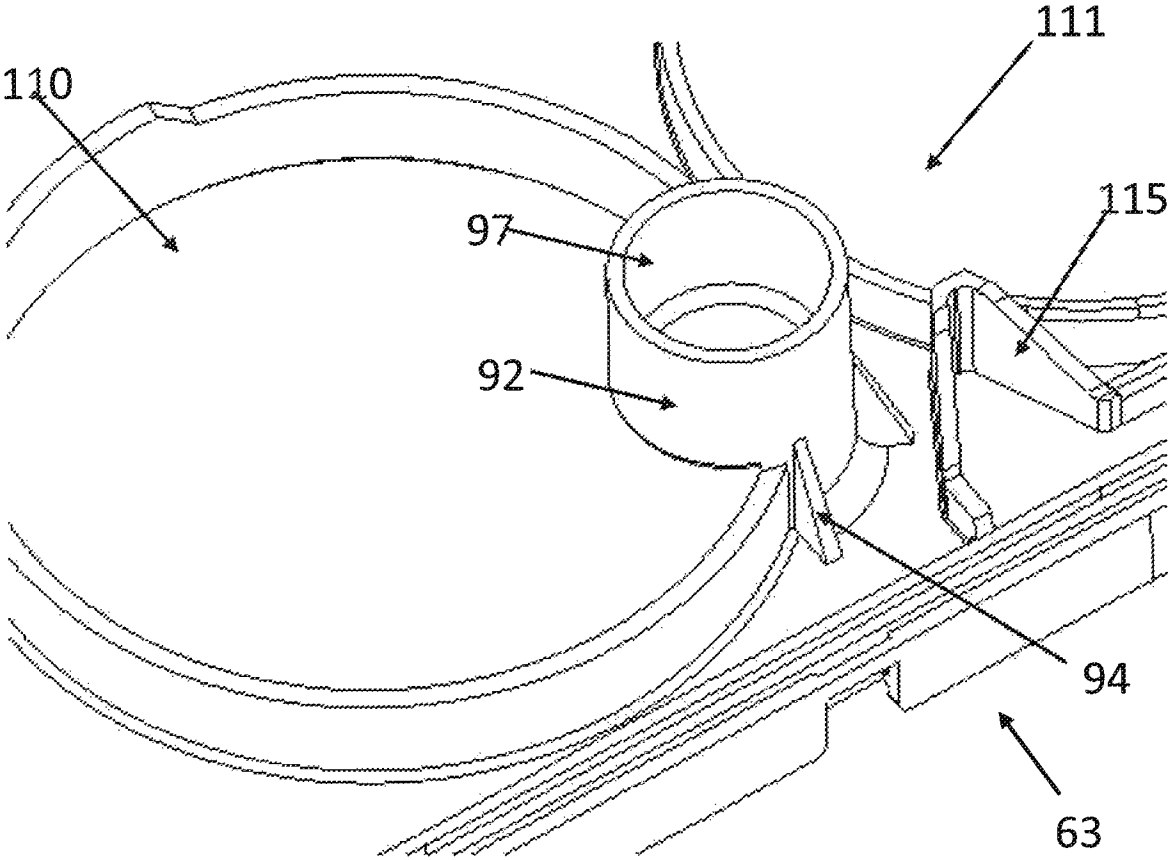
FIG. 24 is an isometric view of a portion of the cover of the additive dispenser of the present invention in its preferred embodiment, highlighting the mushroom shaped cover lid of the siphon system with its corresponding reinforcement ribs on the cover lid.

The bleach deposit 65, as opposed to the detergent deposit 66 contains the wash liquid, subsequently extracting it by means of a siphon system 90 which is illustrated in FIGS. 23, 24 which is comprised of a cylindrical body 91 with reinforcement ribs at the base 93 which avoid that through use, the cylindrical body 91 of the siphon system 90 does not get to correctly fit into the mushroom shaped cover lid 92 of the siphon system 90, which forms part of the cover 63 in the same manner with a set of reinforcement ribs 94 on the cover lid. In addition to the wash water which is released by means of the bidirectional deflector 85, the bleach deposit 65 also comprises a waterfall 86 formed by a wall 87 of the waterfall 86 and a base 88 of the waterfall 86 which are found in a recessed manner on the wall of the bleach deposit 65 on the fourth section 123 of the additive dispenser 60, in such a way that given the surface tension said water fall 86 provides the siphon system 90 with at least one thread of wash water entrapping it into a depressing 95 which encircles the cylindrical body 91 of the siphon system 90 keeping it active and extracting at the same time the chlorine volume deposited into said bleach deposit 65.

Figure 25:
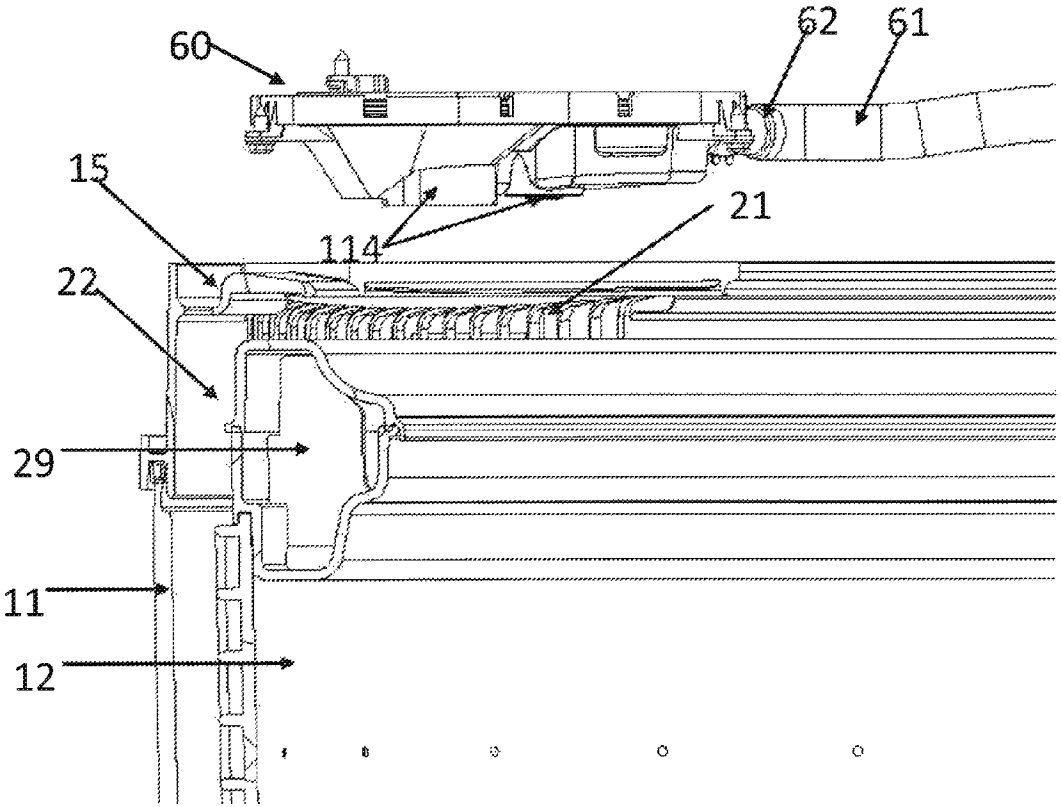
FIG. 25 is an isometric view of a cross cut of the washing machine where the additive dispenser of the present invention and the tub cover reservoir, as well as the grill through which the wash liquor falls between the tub and the basket are highlighted.

It is in this way, that the additive dispenser 60, of the present invention directs the wash liquor, so that in a jet like manner, it falls down through the tub cover reservoir 22 over the grill 21 as can be seen in FIG. 25, where said grill 21 allows the passage of the wash liquor between the tub 11 and the basket 12, avoiding contact with the objects to be washed, thus depositing the wash liquor at the bottom of the basket 12, which allows for uniformly mixing of the chemicals with the water without pouring the chemicals directly over the garments to be washed which can cause spots due to the chemical attack on the surface of said garments as a consequence of poor dilution of the chemicals with the water.

The next step is the electronic control 40 sends a pulse to the driver of the spray pump (not shown), which allows this to supply the wash liquor during the width of the referred pulse to the spray deflector 19, spraying the wash liquor unto the objects to be washed which are found placed within the basket 12.

The duration of the referred pulse having expired, the steps are repeated for a determined amount of time, or at least for as long as one revolution of the basket 12, in such a manner that the objects to be washed which are contained within the basket 12 get soaked with the wash liquor which has accumulated at the bottom of the tub 11.

This is followed by once having transferred all or the great majority of the water volume accumulated at the bottom of the tub 11 towards the objects to be washed, the electronic control 40, sends a pulse to the driver of the motor (not shown) remembering that the clutch 30 is found in a dehydrated manner. This allows the basket 12 to rotate the objects to be washed contained in said basket 12, where upon rotating at a certain velocity for a determined amount of time the wash liquor is extracted from the textiles and is collected at the bottom of the tub 11.

Followed by the electronic control 40 sending a pulse for a determined amount of time to the driver of the drain pump (not shown) so that it may begin to pump the wash liquor from the bottom of the tub 11 towards outside through the drain hose (not shown) which is found at the exit.

Variations to the structure of the additive dispenser described in the present invention may be foreseen by those with expertise in the field. However, it should be understood that present specification corresponds to the preferred embodiment of the invention which is merely for illustrative purposes, and should not be considered as limitative to the invention. All modifications within the scope of the invention described which are not mentioned, as could be alternative to the configuration of the perimeter pathway 60 of the additive dispenser of the present invention should be considered within the scope of the attached claims.

What is claimed is:

1. An additive dispenser for an automatic washing machine, the dispenser having an entrance and an exit, the dispenser comprising:

a) a container with at least one compartment for a wash additive, Wherein the at least one compartment has at least one siphon system and at least one waterfall on one wall of said at least one compartment;

b) a cover joined to the container;

c) one flow homogenizing system at the entrance of the additive dispenser comprising:

a connection nozzle with an inner part, wherein the connection nozzle allows communication with a wash water supply source, and wherein the inner part of said connection nozzle has two ends, wherein one end has a greater diameter than the other end to produce a Venturi effect;

a damping tank having a hydraulic cushion and a cover lid, wherein the hydraulic cushion and the cover lid fit together, and wherein the homogenizing system allows homogenizing wash water flow which enters into the additive dispenser;

d) a perimeter pathway for the transfer of the wash water wherein the perimeter pathway is formed by the container and the cover; and e) at least one deflector to direct the wash water flow which travels through said perimeter pathway.

2. The additive dispenser such as described in claim 1, wherein:

said cover is joined to the container by means of a plastic joining method selected from among adhesive, hot plate, ultrasound, welding, pressure closure or any combination of these.

3. The additive dispenser such as described in claim 1, comprising:

at least one maximum level indicator which forms part of the main cover of the washing machine.

4. The additive dispenser such as described in claim 1, wherein:

said perimeter pathway is a channel and the configuration of the container and the cover allows there to be an open surface.

5. The additive dispenser such as described in claim 1, wherein:

said perimeter pathway is a duct and the configuration of the container and the cover forms a closed pathway delimited by solid surfaces.

6. The additive dispenser such as described in claim 1, wherein:

said perimeter pathway is a combination of:

a channel and the configuration of the container and the cover allows there to be an open surface, and a duct and the configuration of the container and the cover forms a closed pathway delimited by solid surfaces.

7. The additive dispenser such as described in claim 1, wherein:

said at least one deflector is formed by protrusions of e cover and deflections of the container; and said at least one deflector is bidirectional in order to divide the flow between additive compartments by means of a "V" shaped protrusion.

8. The additive dispenser such as described in claim 1, comprising:

at least one safety grill at the exit of the at least one compartment, on which a bay in fluid communication with said perimeter pathway is located.

9. The additive dispenser such as described in claim 1, wherein:

said siphon system is formed by a cylindrical body of the container and a mushroom shaped cover lid set on the cover;

said siphon system comprises reinforcement ribs on a base of the cylindrical body and on the cover to avoid deformations; and said siphon system comprises a depression surrounding the base of the cylindrical body.

10. The additive dispenser such as described in claim 1, wherein:

said waterfall comprises a recession which is located on the same compartment of the siphon system and is in fluid communication with said siphon system ensuring, due to the surface tension, at least one trickle of wash water to said siphon system.

11. The additive dispenser such as described in claim 1, wherein the damping tank and the cover lid fit together by means of a coupling groove and a coupling joint.

12. The additive dispenser such as described in claim 1, wherein the outer part of the connection nozzle is a cylinder.

13. The additive dispenser such as described in claim 1, wherein the connection nozzle is a truncated cone.

14. A clothes washing machine comprising an additive dispenser such as described in claim 1.

15. The clothes washing machine according to claim 14, wherein the washing machine is a vertical axis washing machine.

* * * * *